US006883579B2

(12) United States Patent
Olmsted

(10) Patent No.: US 6,883,579 B2
(45) Date of Patent: Apr. 26, 2005

(54) DRIVE SYSTEM FOR GARAGE DOOR

(75) Inventor: Robert J. Olmsted, Wood Dale, IL (US)

(73) Assignee: The Chamberlain Group, Inc., Elmhurst, IL (US)

( * ) Notice: Subject to any disclaimer, the term of this patent is extended or adjusted under 35 U.S.C. 154(b) by 0 days.

(21) Appl. No.: 10/395,407

(22) Filed: Mar. 24, 2003

(65) Prior Publication Data

US 2004/0060669 A1 Apr. 1, 2004

Related U.S. Application Data

(63) Continuation-in-part of application No. 10/142,198, filed on May 9, 2002, now abandoned.

(51) Int. Cl.[7] ..... E06B 3/92

(52) U.S. Cl. ..... 160/189; 160/201; 160/209; 49/199; 49/200

(58) Field of Search ..... 160/189, 188, 160/201, 209; 49/199, 200

(56) References Cited

U.S. PATENT DOCUMENTS

| | | | | | |
|---|---|---|---|---|---|
| 3,773,294 | A | * | 11/1973 | Alcott | 254/346 |
| 4,253,350 | A | * | 3/1981 | De Tarr | 81/486 |
| 4,858,253 | A | * | 8/1989 | Lamb | 4/502 |
| 5,193,307 | A | * | 3/1993 | Chupp | 49/123 |
| 5,529,258 | A | * | 6/1996 | Dybro et al. | 242/374 |
| 5,743,046 | A | * | 4/1998 | Siegler et al. | 49/199 |
| 5,761,850 | A | * | 6/1998 | Lhotak et al. | 49/360 |
| 5,803,149 | A | * | 9/1998 | Halley et al. | 160/201 |
| 5,996,670 | A | * | 12/1999 | Igarashi | 160/133 |
| 6,051,947 | A | * | 4/2000 | Lhotak et al. | 318/445 |
| 6,164,014 | A | * | 12/2000 | McDowell et al. | 49/200 |
| 6,173,532 | B1 | | 1/2001 | Beausoleil | |
| 6,257,303 | B1 | | 7/2001 | Coubray et al. | |
| 6,263,947 | B1 | * | 7/2001 | Mullet | 160/191 |
| 6,326,751 | B1 | | 12/2001 | Mullet et al. | |
| 6,615,897 | B1 | * | 9/2003 | Dorma | 160/191 |
| 6,712,116 | B1 | * | 3/2004 | Beaudoin et al. | 160/188 |
| 2003/0217820 | A1 | * | 11/2003 | Stoltenberg | 160/192 |

FOREIGN PATENT DOCUMENTS

| | | |
|---|---|---|
| WO | WO 98/21438 | 5/1998 |
| WO | WO 98/21504 | 5/1998 |
| WO | WO 99/50520 | 10/1999 |

OTHER PUBLICATIONS

Arrow Tru–Line, Inc. Brochure (3 pgs.).

* cited by examiner

*Primary Examiner*—Bruce A. Lev
(74) *Attorney, Agent, or Firm*—Fitch, Even, Tabin & Flannery

(57) ABSTRACT

A drive system is provided for a moveable barrier, such as a garage door, that limits unauthorized shifting thereof. The drive system includes a flexible actuator for raising and lowering the door. The flexible actuator is tensioned with a biasing mechanism to minimize actuator throw, and a stop assembly of the biasing mechanism limits unauthorized travel of the garage door from the closed position by a predetermined amount that is sufficiently small so as to keep intruders out of the garage. The flexible actuator may for example, be a cable, a belt or a chain.

33 Claims, 15 Drawing Sheets

DRIVE SYSTEM FOR GARAGE DOOR

RELATED APPLICATIONS

This application is a Continuation-In-Part of U.S. patent application Ser. No. 10/142,198 filed May 9, 2002 now abandoned.

FIELD OF THE INVENTION

The invention relates generally to a drive system for shifting a movable barrier and, more particularly, to a drive system for shifting a garage door using a flexible actuator.

BACKGROUND OF THE INVENTION

Garage door systems, such as shown in U.S. Pat. Nos. 5,803,149 and 6,326,751, include a garage door that is normally shifted between a substantially vertical orientation, where the door is in a closed position, and a substantially horizontal position, where the door is in an open position. Jack shaft operators as disclosed in the '149 patent are available that employ a spring-loaded drive shaft to assist in controlled shifting of the heavy weight of the door as it is moved between its horizontal open and vertical closed positions along a guide track as by application of a counterbalancing force thereto. For lifting the door open, a pull cable connected near the bottom of the door is spooled on a drum mounted to the rotating shaft.

Garage door systems have been developed that also use an upper cable operatively connected adjacent the top of the door to pull the garage door from the open position to the closed position. The upper cable is tensioned with an extension spring, such as disclosed in the aforementioned patents. The '751 patent also shows a torsion spring that exerts a torsional or rotational force on links that are pivotally connected in order to tension the cable. Such a torsion spring and link arrangement introduces undesirable complexities and pivot points that can quickly wear and fail with repeated cycling and especially over prolonged periods of garage door operation.

During winding and unwinding of the cables from the drum or drums, the cables are more likely to spool onto the drums improperly or actually fall off of the drums, also known as cable throw, unless properly tensioned. In particular, the cable not bearing the majority of the load tends to come off of its drum unless properly tensioned. For example, when the door is nearly to its closed position, the majority of the door's weight is supported by the lower cable, thus reducing the tension in the upper cable which, unless proper tension is applied, results in cable throw. Cable throw causes the improper winding and/or unwinding of the cable from the drum, resulting in the malfunction of the garage door system in terms of properly opening and closing as is desired.

The use of extension or coil springs to tension upper cables of garage door systems is problematic from a security standpoint. More specifically, extension springs are attached between the upper cable and the door. Generally, there is a pivotal bracket arm attached adjacent the upper end of the door at one end and to a roller at its other end with the spring operatively attached between the arm and cable. Accordingly, with the door closed, the spring allows an intruder to exert an upward lifting force on the door to push the roller in the guide track with the spring deflecting or stretching, thus raising the door despite lack of rotation of the drive shaft and drum on which the upper cable is spooled. In other words, the intruder can lift the door by way of spring deflection, even though the length of the upper cable between the drum and spring does not increase. The intruder usually will be able to lift the door by deflection of the spring by a vertical amount sufficient so that they can gain access to the interior of the garage by fitting under the door, e.g., by lifting the door by a height off the ground large enough for the intruder to pass through. Further, if the yield strength of the spring is exceeded, the overflexed spring may not be able to exert the same tensioning force on the cable and generally will see its usable spring life cycles reduced. In some instances an intruder may stretch the spring so that the spring breaks, thereby allowing the garage door to be lifted completely up.

A further complication in designing drive systems comes from the use of multi-panel doors that travel curved paths as these doors move between open and closed positions. As the panels pivot relative to adjacent panels during travel along the curved path, the respective distances traveled by between the top end and the bottom end of the door are not the same for a given elevation of the door. Since the upper and lower cables are attached to these ends of the garage door, the length of travel required of the upper cable also varies relative to the length of travel required of the lower cable as the door is raised and lowered. The variance in the travel distance of the cables can cause fluctuations in the tension in the cables, which can result in the build up of slack and thus cable throw.

SUMMARY OF THE INVENTION

In accordance with the invention, a drive system for a moveable barrier, e.g., garage door, is provided that limits unauthorized shifting thereof. In particular, the drive system includes a biasing mechanism having a biasing member, such as a compression spring, associated with a flexible actuator, e.g., cable or chain, operably connected between a drive shaft and the door such as toward the upper end thereof for keeping the cable actuator tensioned. The biasing mechanism also includes a stop assembly which provides a well-defined, generally precise limit to the amount of deflection or flexing the compression spring can undergo. In this way, the present biasing mechanism incorporating the stop assembly only allows the garage door to be lifted from the closed position without operation of the drive shaft by a predetermined small, vertical distance that is insufficient in terms of allowing unauthorized access to the garage. At the same time, the stop assembly does not allow the spring to be overflexed even when the stop assembly is operable to stop unauthorized door shifting thus maintaining spring performance for actuator tensioning and maximizing the life thereof.

It is preferred that the biasing member exert a linearly directed biasing force with the stop assembly being connected to the mechanism for similarly flexing the member in the linear direction, preferably in line with the cable actuator. In this way, operation of the biasing mechanism and stop assembly thereof do not require pivot members for transmission of the tensioning force to the cable and the wear and reliability problems these pose.

As is apparent, this linearly directed biasing force is akin to that provided by prior extension springs which, however, lack the stop assembly of the present invention. In this manner, the present biasing mechanism can be implemented in much the same manner as prior extension springs in terms of the surrounding hardware necessary for attaching it between the cable and the door. For instance, the normal arm having a roller riding in the guide track for the door and being pivotally mounted to the upper end of the door at one end with the other having a bracket for pivotally attaching to the present biasing mechanism can generally still be employed with only relatively minor modifications thereto. Accordingly, the present drive system can more easily be substituted for prior systems employing extension springs with a minimum of added expense and effort for installation and retrofitting thereof.

In the preferred and illustrated form, the biasing mechanism and connected stop assembly are a commercially available extension spring assembly that include pull devices. The pull devices include a pair of elongate U-shaped loops that each pass through the barrel of the coils in opposite directions to each other and hook around the opposite end coils of the spring so that when a tension force is applied to the loops, they pull toward each other compressing the spring coils together. Once the coils are completely compressed, there is a hard, physical limit to the deflection of the spring regardless of loading so that the garage door cannot be lifted further once this point is reached. In addition, this prevents the spring from being overflexed or overstretched which otherwise can adversely effect the bias force applied by the spring to keep the cable tensioned and can reduce spring life.

It should be noted that the construction of the present spring assembly is interchangeably called an extension or a compression spring as it includes physical characteristics of both. Common characteristics include loops that in operation are pulled away from each other similar to expansion springs. The loops are connected to hooks of the pull devices that are operable to pull the opposing end coils toward each other to compress the coils together like operation of a compression spring when the loops are pulled as described. Nevertheless, the present spring assembly is constructed to provide additional advantages over simple extension or compression springs, as described herein.

More specifically and in a preferred form, the present drive system is employed with a jack shaft garage door operator including a drive shaft that is driven to raise the garage door from the closed position via a lower cable that is taken up to pull the door toward the open position while the upper cable pays out. Conversely, when the drive shaft is driven to lower the garage door from the open position, the upper cable is taken up to pull the door toward the closed position while the lower cable pays out. Once the upper cable begins to urge the garage door toward its closed position, the lower cable assists in supporting the weight of the door as it is being lowered.

As mentioned, the biasing mechanism is provided between the cable and the garage door in order to provide tension to the upper cable. The biasing mechanism includes a spring, as discussed above, to provide sufficient tension to the cable to prevent the cable from being thrown off of the drum or otherwise hindering movement of the door. The spring of the biasing mechanism is configured to apply tension to the flexible actuator within a range before the spring is completely compressed to a predetermined maximum limit, i.e., about two inches. When the predetermined maximum limit is reached, the stop assembly does not allow further resilient flexing of the spring and movement of the garage door beyond the predetermined limited amount when the drive shaft is not rotated.

Many garage doors include a plurality of pivotally connected panels with connected rollers positioned within the guide track. The track has a generally vertical portion for supporting the garage door in the closed position and a generally horizontal portion for supporting the door in the open position. Connecting the vertical and horizontal track portions is an arcuate portion.

As the rigid panels are pivoted for articulating to travel along the arcuate track portion, the upper and lower cables will travel by different distances with respect to each other for a given position of the garage door between the closed and open positions. As one is being paid out and the other is being taken up by the rotating drum(s) to which they are secured, as previously discussed. It has been found that the travel differences between the cables vary and oscillate in a fairly predictable range that can be measured. At different positions of the door between its open and closed positions, there is a travel differential amount, i.e., the difference the upper cable has traveled relative to the lower cable. The travel differential amount varies depending upon the position of the garage door. Throughout the travel of the door there is a largest measured difference, which is termed the maximum travel differential amount. As is apparent, since the cable drum is mounted on the rotating drive shaft that is fixed in position relative to the door, the lack of a constant one-to-one correspondence between the cable travel distances creates slack in the cables, and most typically the upper cable, during garage door operations.

While prior extension springs would generally allow a sufficient amount of deflection to take-up the maximum travel differential amount so as to keep the cables tensioned during garage door operations, these springs are typically oversized in that they have almost no practical limit on the maximum deflections, thereby allowing far greater deflection that the maximum differential travel amount. In other words, there has been no consideration given to the travel differential, and certainly these prior drive systems have not identified the maximum travel differential as being of importance.

Accordingly, in another form of the invention, a drive system is provided that has a pair of flexible actuators, i.e., cables, connected to shift the movable barrier. A resilient take-up device that provides one of the actuators with a biasing force by resilient deflection or flexing minimizes slack in the actuator due to the travel differential. The take-up device is provided with a limit assembly which defines a predetermined maximum limit of deflection of the take-up device. In particular, the limit assembly allows the maximum deflection limit to be preselected to generally correspond to the maximum travel differential. In this way, the present take-up device can be carefully tailored to provide the deflection or flexing and bias force to the flexible actuator that is needed to avoid slack due to travel differential, while avoiding the over sizing thereof as occurred with prior extension springs that were not selected based on an identification of the maximum travel differential amount similar to the take-up device incorporating the limit assembly herein. At the same time, the limit assembly avoids overflexing of the take-up device such as could occur if an intruder is attempting to push the door up, which could deflect and stretch the prior extension springs of the upper cables until they can gain access by fitting under the door to the garage.

As previously discussed, the resilient take-up device is preferably in the form of a compression coil spring and the limiting stop assembly preferably includes a pair of opposing drawbars having the compression spring positioned therebetween. The drawbars and spring are configured and arranged to apply tension to the cable when the drawbars are drawn toward each other due to the biasing force of the spring. When the spring coils are fully compressed between the drawbars, the maximum limit of applied tension to the flexible actuator is reached. The engagement of the drawbars against the fully compressed coils of the spring prevents further extension of the flexible actuator, thereby allowing the upper cable to become taunt. If this point has been reached without rotation of the drive shaft, i.e., by an intruder lifting the door, further unauthorized shifting of the garage door is prevented.

Over time, the cable may stretch and deform so that it is longer than its initial length. If the cable increases in length, then the biasing mechanism is required to take up the slack in the cable so that tension in the cable stays relatively constant. The compression spring needs to deflect or expand axially taking up the preload initially set therein as described hereinbelow thus requiring an increase the length between opposite end coils to pull the two opposing drawbars closer together, and particularly the loop connection points thereof. However, as mentioned above, the distance between the two opposing drawbars and the preloaded, partially compressed axial length of the spring are carefully selected to permit deflection of the spring generally corresponding only to the maximum travel differential amount. The change in the distances in the drawbar spring assembly, such as by taking up slack in an elongated cable, reduces the ability of the spring assembly to compensate for the predetermined maximum travel differential amount. In other words, if the coil spring becomes axially longer than it is in its preloaded, partially compressed state, the drawbars will no longer fully compress the cables when the maximum travel differential amount is reached.

In order to maintain a generally constant maximum differential travel amount, even when the upper cable lengthens over time, herein a tensioner is provided between the arm pivotally attached to the door at one end and to the spring assembly at its other end. The distance between the connection point of the tensioner relative to the arm is made to be adjustable. The tensioner includes an adjustment device so that the connection point can be controllably shifted relative to the arm in order to change the distance between the connection point and the drive shaft prior to garage operations. In this manner, the preload tensioner allows a user to more precisely set the tension in the upper cable during system set-up procedures, such as with the door in its closed position. Shifting the connection point further away from the shaft via the preload tensioner allows for the take up of slack in an elongated upper cable to maintain the spring at its preload, partially compressed axial length which accommodates the maximum travel differential amount.

The tensioner may include a supplemental adjustment mechanism that causes the connection point to automatically shift away from the shaft, such as in predetermined increments, to take up slack in the upper cable. In this manner, the tensioner is adapted to allow the drawbar and compression spring assembly to maintain a generally constant range of tension on the cable, even as the cable is stretched and lengthens over time, so that the drawbar and spring assembly stays tailored to address only the necessary amount of the travel differential between the upper and lower cable actuators, namely the maximum travel differential amount as described hereinabove.

Embodiments are also described herein in which a torsion drum is used as a tensioner. The tension drum is connected by a torsion spring to the rotation of a shaft and can rotate with respect to the shaft subject to the restoration force of the torsion spring. Stops to limit the rotation of the torsion drum with respect to the shaft are also provided.

DETAILED DESCRIPTION OF PREFERRED EMBODIMENTS

Figure 1:
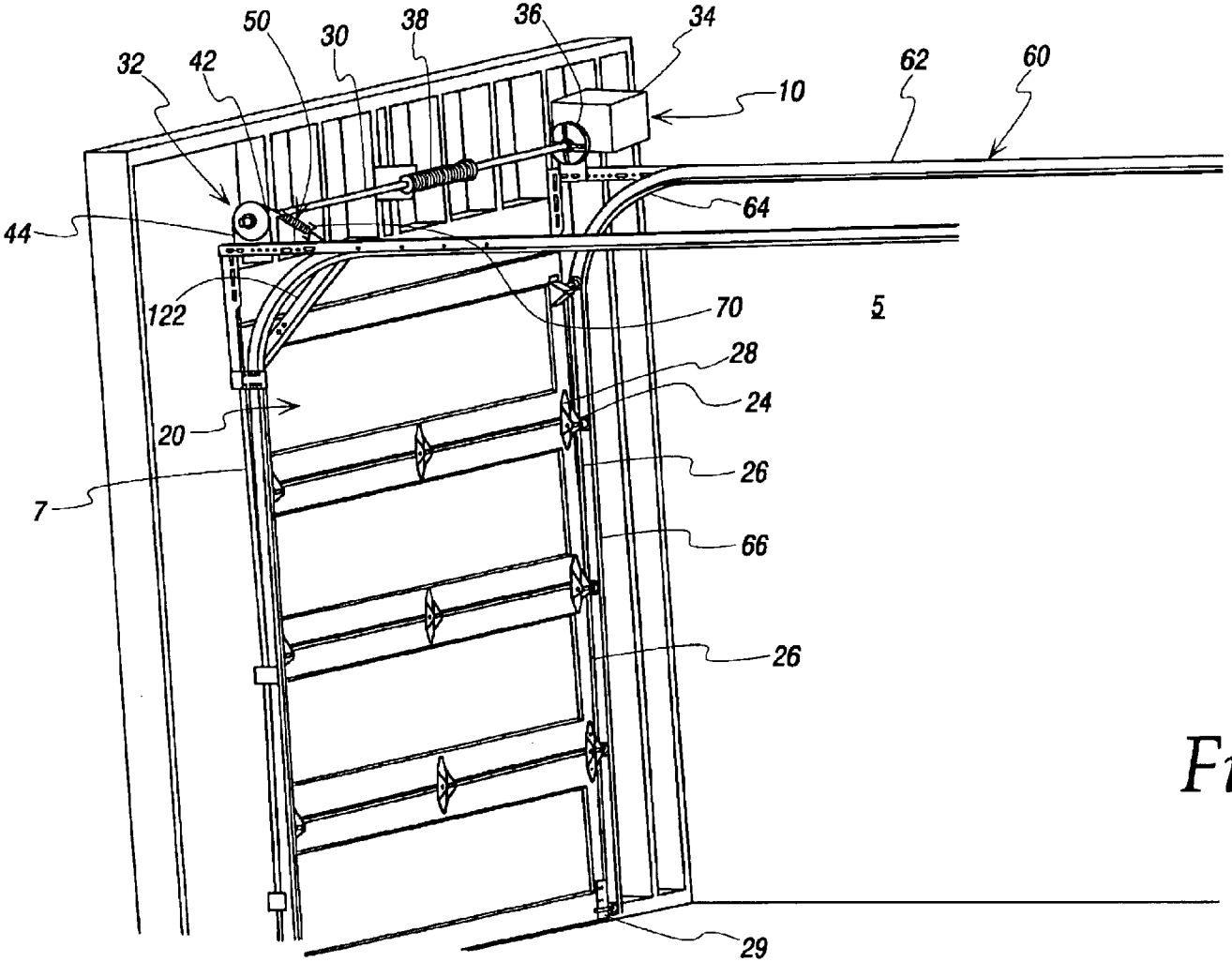
FIG. 1 is a perspective view of a garage door in a closed position thereof and a drive system therefore including a drive shaft and upper and lower flexible cable actuators operatively attached to the door in accordance with an embodiment of the invention.
Figure 2:
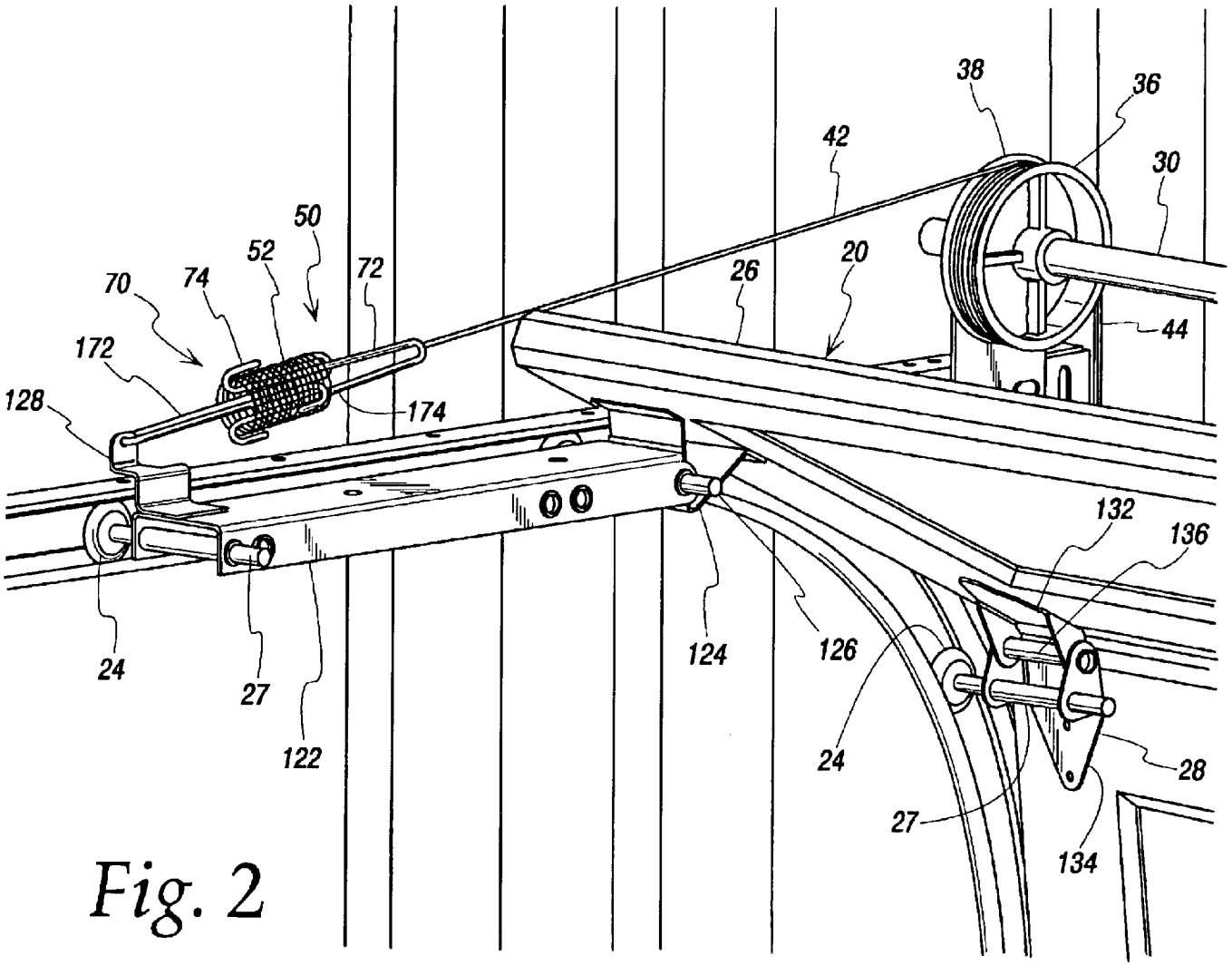
FIG. 2 is an enlarged perspective view of the drive system showing a spring assembly attached between the upper cable and an arm pivotally attached adjacent the upper end of the door with spring assembly coils that are compressed to apply a tension force to the cable as the door is being shifted.
Figure 3:
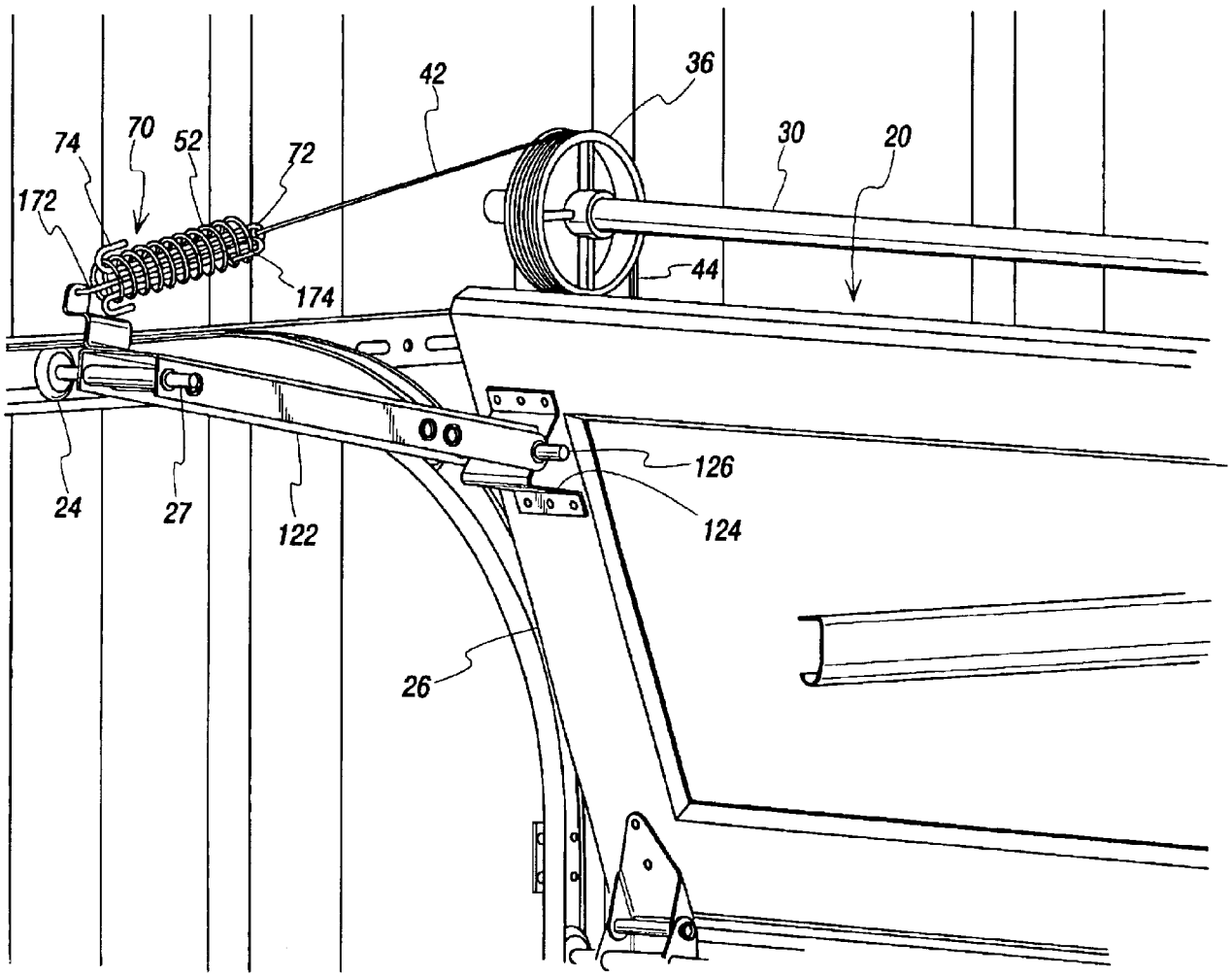
FIG. 3 is a view similar to FIG. 2 showing the door lowered closer to its closed position with the coils of the spring assembly expanded for decreasing the applied tension force to the cable.

In FIGS. 1–3, a garage door 20 and its drive system 10 are shown for shifting the door 20 between a closed position (FIG. 1) and an open position in accordance with the present invention. More particularly, the drive system 10 includes a lower cable 44 that exerts a lifting force on the vertical door 20 as it is shifted to the open position, which as shown will be with the door 20 in a generally horizontal orientation due to the configuration of its guide track 60. Most residential garage door systems will have a vertical portion or run 66 that guides the door to its closed position and a horizontal portion or run 62 adjacent and below the ceiling of the garage 5 so that the door 20 is lifted open to a horizontal position. A curved or arcuate track portion 64 interconnects the vertical and horizontal track runs 66 and 62, as is known. For shifting the door 20 closed, the present drive system 10 includes an upper cable 42 that is operable to exert a closing force on the door 20.

With the drive shaft 30 being a component of the typical jack shaft operator 32 and disposed over the garage door opening 7 as shown in FIG. 1, and having drums 36 on which the cables 42 and 44 are spooled, the lower cable 44 is operatively connected toward the lower end of the door 20, and the upper cable 42 is operatively connected toward the upper end of the door 20. In this regard, an extension arm 122 is pivotally attached to the door 20 via a bracket 124 and pivot pin 126 at one end of the arm 122. As best seen in FIG. 2, a biasing mechanism or resilient take-up device 50 is shown pivotally attached between the other end of the arm 122 via a bracket 128 secured thereto. The biasing mechanism 50 keeps tension in the cable 42 so that it does not develop slack during garage door operations.

The biasing mechanism 50 is also provided with a stop or limit assembly 70 that provides a hard stop to the maximum deflection the biasing member in the form of a coil spring 52 can undergo. In the present embodiment the stop or limit assembly includes drawbars 72 and 172. In this manner, unlike prior extension springs, the present biasing mechanism 50 provides a precise, known limit to how much shifting the door 20 can undergo without operation of the rotating drive shaft 30. Accordingly, with the door 20 closed an intruder attempting to gain access to the interior space of the garage 5 will only be able to lift the closed garage door 20 off from the ground by a predetermined limited amount which is defined by the arrangement of the coil spring 52 and the stop assembly 70. On the other hand, the present biasing mechanism 50 employs the coil spring 52 advantageously as it applies a linear bias force for tensioning the cable 42 with the force in line or coaxial with the cable 42 so as to keep the number of pivoting parts in the present biasing mechanism 50 to a minimum. In addition, by utilizing a coil spring 52 similar to prior extension coils springs but having a stop assembly 70 incorporated therewith, the present biasing mechanism 50 can be more readily installed in current garage door drive systems that employ an upper cable with an extension spring for keeping tension thereon without requiring significant modifications thereto. In the preferred form, the present biasing mechanism 50 can be a commercially available drawbar spring assembly such as provided by McMaster-Carr of Chicago, Ill. These spring assemblies 50 have a size or form similar to prior extension springs so they can be easily substituted therefor. Furthermore, this allows the drive system 10 incorporating the biasing mechanism 50 as described herein to be implemented with a minimum of expense as custom made parts therefor are avoided.

Figure 4:
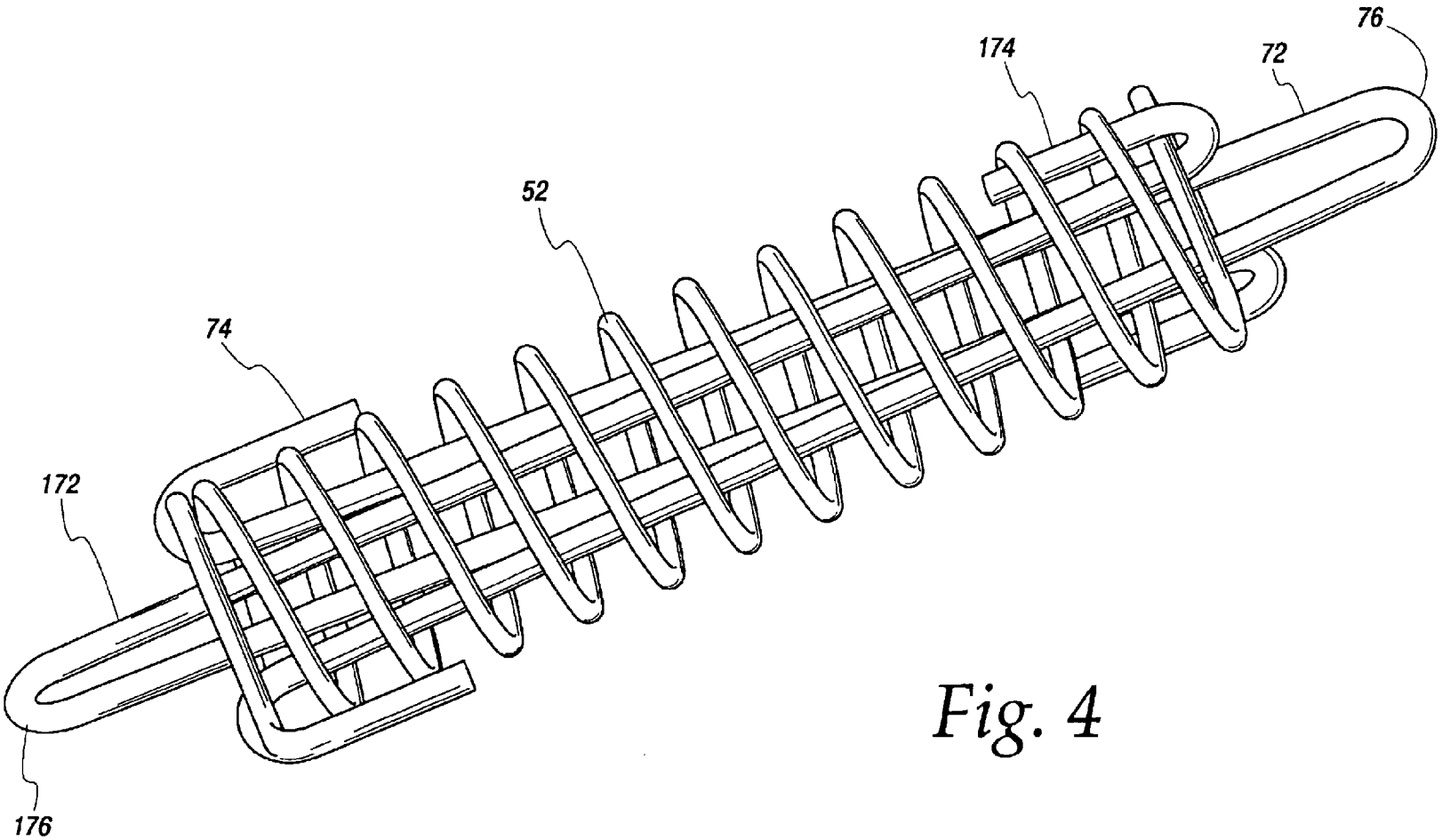
FIG. 4 is perspective view of the spring assembly showing a compression spring and a pair of drawbars extending therethrough with each drawbar including a connection loop and a hook end.

Referring to FIG. 4, the drawbar assembly 70 includes a pair of drawbars 72 and 172 that extend through the barrel of the spring coil 52 in opposite directions. The drawbars 72 and 172 each include a loop 76 or 176 at one end and hooks 74 or 174 at the other end. Accordingly, there is a loop 76 of one drawbar 72 that projects beyond one end of the coil spring 52 while the hooks 174 of the other drawbar 172 are engaged about the coils thereat. The loop 76 is connected to the end of the upper cable 42 while the other loop 176 is connected to the bracket, 128 of the arm 122, as best seen in FIGS. 2 and 3. Thus, the coil spring 52 is loaded by axial compression such as during system set-up for preloading thereof as will be described hereafter, and during garage door operations either by the arm 122 pushing on the loop 176 causing the hooks 174 to pull on the end coil for compressing the coils during door opening operations, or by take-up of the cable 42 on the drum pulling on drawbar loop 76 causing hook end 74 to pull on the end coil for compressing the coils 52 during door closing operations. Accordingly, unlike prior extension springs, there is an axial shortening of the coil spring 52 that is effective to load the biasing mechanism 50 for keeping tension on the upper cable 42.

In each instance when the door 20 shifts as by drive shaft rotation, the above-described arrangement of the drawbars 72 and 172 allows the assembly 50 to exert a linear compressive force on the coil spring 52 aligned with the force applied by the spring assembly 50 to the upper cable 42. As is apparent, the drawbars 72 and 172 can only pull the coils together until they all are engaged with adjacent coils. At this point, the coil spring 52 can not be deflected further, thereby providing a well-defined limit to its maximum deflection which cannot be exceeded. In this manner, the present spring assembly 50 cannot be overflexed as possible with prior extension springs. Importantly, the hard limit provided to the spring deflection is effective in stopping unauthorized entry into the garage door space 5 as no longer will an intruder be able to continually stretch and deflect the spring 52 of the upper cable 42 until they can fit under the door 20. Again, this overflexing is avoided with the present drawbar spring assembly 50 along with the potential for plastic deformation thereof, and even complete failure of the coil spring 52. More specifically, when an intruder attempts to open the fully closed garage door 20 without the drive shaft 30 being driven for rotation by the operator motor 34, the garage door 20 will initially move along the track 60 toward its open position with the lower end of the door 20 raised off from the ground. While the garage door 20 is being lifted upwardly, the distance between the drawbar 176 and arm 122 connection and the drum 36 increases from its nominal distance, with the upper cable 42 tensioned and coils of the compression spring 52 shifting axially toward each other. When the coils have shifted linearly along their axis by the maximum deflection amount due to the lifting force, they are fully axially compressed between the hooks 74 and 174 of the opposing drawbars 72 and 172 so that with the upper cable 42 fully taunt the door 20 cannot undergo any further upward movement as might allow an intruder access to the garage interior space 5.

As the drawbar spring assembly 50 is commercially available in different sizes, it can be selected so that the amount of shifting or lifting of the door 20 absent drive shaft rotation and motor operation will be known in advance, with allowance taken in to account for preloading of the spring assembly 52, as will be described herein. The limited amount of shifting that is allowed can be selected to be, for example, approximately two inches with the coil spring 52 preloaded as by axially compressing the coils by approximately two inches with the door 20 lifted off of the ground by this short vertical distance, e.g. two inches, at which point further raising of the door 20 cannot occur substantially irrespective of the manual lifting force applied by an intruder, and they will be unable to fit under to door 20 to effectively keep them out of the garage interior space 5.

Many garage doors 20 are of a multi-panel construction including several panels 26 that are hinged together to allow them to pivot relative to each other. As seen best in FIGS. 1–3, the panels 26 have a hinge 28 adjacent each lateral side thereof and in the midsection thereof. The hinges 28 each include an upper hinge portion 132 attached to the lower end of the upper adjacent panel 26 and a lower hinge portion 134 attached to the upper end of the lower adjacent panel 26. Connecting the two hinge portions 132 and 134 is a pivot pin 136 that allow the hinge portions 132 and 134, and thus the adjacent door panels 26, to pivot relative to each other.

Rollers 24 are positioned to extend past the lateral edges of the door 20 for traveling in the track portions 62, 64, and 66. The rollers 24 are mounted in several locations. Some of the rollers 24 are mounted to the hinges 28 adjacent the lateral edges of the panels 26 via pins 27 with rollers 24 on the ends thereof rotatable mounted thereto. As best seen in FIG. 2, the roller pins 27 can be mounted to the lower hinge portions 134. The roller pin 27 and the pivot pin 136 may also be combined. That is, the same pin that pivotally connects the upper and lower hinge portions 132 and 134 may also extend past the lateral edge of the door panel 26 and have a roller 24 mounted thereto for travel in the track 60. Other rollers 24 may have their roller pins 27 mounted to the garage door 20 via brackets 29 and 124 independent of the hinges 28. For example, rollers 24 may be mounted to pins 27 attached to brackets 29 and 124 fixed adjacent to lateral edges of the door 20 at the top end of the uppermost panel 26 and the bottom end of the lower most panel 26 for guiding the top and bottom of the door 20. Rollers 24 are also mounted relative to both ends of the arm 122 to guide the arm 122 along the track 60. These rollers 24 have pins 27 that extend through holes in the end of the arm 122 pivotally attached to the door 20 with a hinge bracket 124 and the end opposite the door 20.

The positions of the rollers 24 relative to the panels 26 and the arm 122 are carefully selected to allow the door panels 26 and arm 122 to travel through the arcuate portion 64 of the track 60. For instance, the rollers 24 are positioned near the top and bottom ends of the panels 26 and arm 122, as opposed to in the midsections thereof, to allow the panels 26 and arm 122 to move through the arcuate track portion 64 as the panels 26 and arm 122 transition between horizontal and vertical orientations. As illustrated in FIG. 1, for a garage door 20 having four panel sections 26 five rollers 24 are positioned along each lateral side thereof for travel in the track 60, along with one roller 24 at the end of the arm 122 opposite the connection of the arm 122 to the uppermost panel 26 of the door 20. Rollers 24 are mounted to brackets 29 attached toward the bottom end of the bottom most panel 26. A pair of rollers 24 are also connected to a combined pivot pin and roller pin 126 joining the upper and lower hinge portions 132 and 134 of the hinge 28 connecting the lowermost panel 26 to the panel 26 adjacent thereto. The hinges 28 joining the two intermediate panels 26 and the uppermost panel 26 and its adjacent panel 26 each have a roller 24 connected to a roller pin 27 connected to the lower hinge portion 134. At each side of the top end of the uppermost panel 26 a bracket 124 is provided having a roller pin 27 with a roller 24 on the end thereof. For the side of the panel 26 having the arm 122 connected thereto, the combined roller pin 126 also pivotally connects the arm 122 to the bracket 124.

As the door 20 is shifting through its curved path adjacent panels 26 pivot relative to each other which is believed to be at least one reason for the travel differential between the upper and lower cables 42 and 44, as previously described. The present drive system 10 via the resilient take-up device 50 and limit assembly 70 is very well adapted to keep proper tension on the cables 42 and 44 despite the travel differential therebetween during garage door operations. In this regard, the resilient take-up device 50 including the limit assembly 70 is sized with precision to deflect the coil spring 52 by no more than is needed to accommodate the maximum amount of travel differential between the cables 42 and 44. In this way, the size of the take-up device 50 in terms of how much resilient deflection it needs to be able to undergo is kept to a minimum.

Where the resilient take-up device 50 and limit assembly 70 are as shown in their preferred form, i.e., the drawbar spring assembly 50 as shown in FIG. 4, another advantage is that by minimizing the maximum resilient deflection that is selected, the predetermined limited amount of unauthorized garage door 20 shifting allowed by the device is also kept to a minimum. In other words, the maximum resilient deflection is the linear distance that the coils can be shifted or compressed along their axis before they are engaged together or fully compressed by the pulling force on the drawbars 72 and 172. As such, this maximum resilient deflection level also defines the limited amount of door 20 shifting that can occur absent drive shaft rotation. Accordingly, identifying the maximum travel differential between the cables 42 and 44 as done herein allows the drawbar spring assembly 50 to be selected in a way that also affords optimized advantages as the limited amount of allowed door 20 shifting can be kept to a minimum.

As discussed above, the biasing mechanism 50 is preferably preloaded such that the spring 52 is in a partially compressed state when the garage door 20 is in its closed position to tension the upper cable 42. The length of the upper cable 42 when the garage door 20 is in the closed position and/or the size of the spring and drawbar assembly 50 are selected so that the spring 52 is partially compressed to the preselected amount that allows for the spring 52 to be compressed an amount corresponding to the maximum differential travel amount. A supplemental tensioner 80, 89, or 90 is provided to allow for adjustment of the axial distance the spring 52 can compress from its partially compressed state, i.e., when the garage door 20 is in its closed position, to its fully compressed state, to achieve only the amount of garage door 20 travel necessary to compensate for the maximum travel differential amount before further travel is prevented by the stop assembly 70.

Adjustments may be needed when installing a drive system 10 in accordance with the invention, and when retrofitting an existing system with the biasing mechanism 50. In particular, the supplemental tensions 80, 89, and 90 allow for the fine-tuning of the biasing mechanism 50. Adjustments may also be needed periodically over time during use of the garage door drive system 10 due to stretching, and thus an increase in length, of the cables 42 and 44. For example, if the upper cable 42 increases in length, the spring 52 of the biasing mechanism 50 must increase in axial length from its preselected preload length to take up the slack therein due to the increased length thereof. As discussed above, an increased preload spring 52 axial length will allow the garage door 20 to travel from its closed position a greater distance before further travel is prevented by the stop assembly 70 fully compressing the spring 52.

Figure 5:
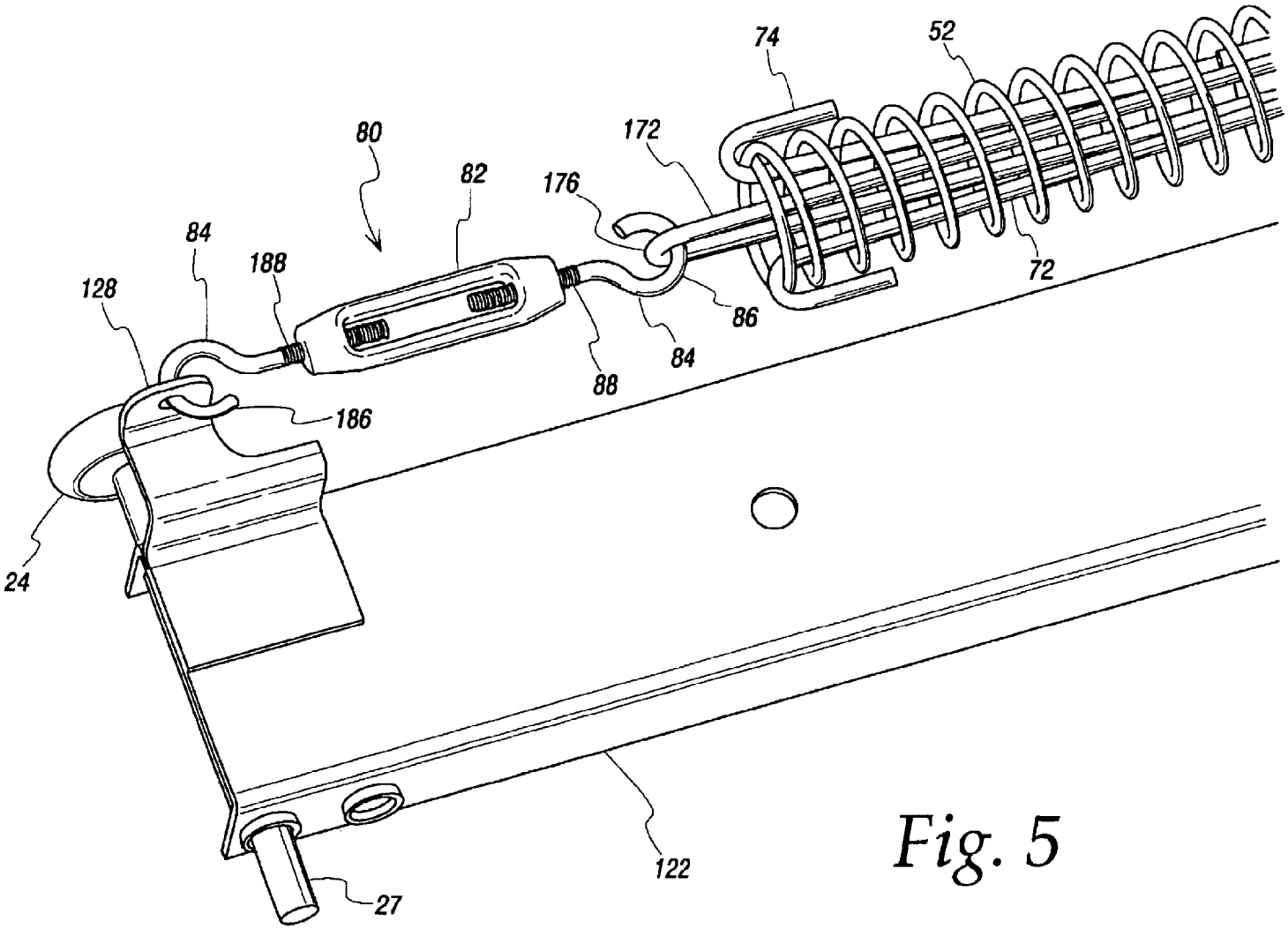
FIG. 5 is a perspective view of a preload tensioner for the drawbar spring assembly showing a turnbuckle including hook screws threaded thereto connected to a bracket attached to the arm pivotally connected to the upper end of the door at one end and to one of the drawbar loops at the other end for keeping the preload in the spring substantially constant during garage door operation.

The supplemental tension 80, as shown in FIG. 5, includes a turnbuckle 82 having hooks screws 84 and 184 with threaded ends 88 and 188 threaded thereinto. The hooked end 86 of the hook screw 84 is connected to the loop end 176 of the drawbar 172 of the spring and drawbar assembly 50. The other hook screw 184 has its hooked end 186 connected to the bracket 128 mounted to the end of the arm 122 opposite the end of the arm 122 attached to the door 20 with the bracket 124. The threads of the threaded ends 88 and 188 of the hooks screws 84 and 184 allow for the distance between the opposing hooked ends 86 and 186 thereof to be increased or decreased, which causes the distance between the bracket 129 and the spring and drawbar assembly 50 to increase or decrease. When the distance is decreased, the hooked end 174 of the drawbar 172 can be set to apply a greater preload to the spring, compressing the spring 52 to the preselected amount necessary allow the spring 52 to be fully compressed once the maximum predetermined travel differential has been reached. Conversely, increasing the distance using the tensioner 80 allows the spring 52 to increase in axial length, increasing the amount of travel of the door 20 before the limit assembly 70 fully compresses the spring 52 to prevent further travel of the door 20.

Figure 6:
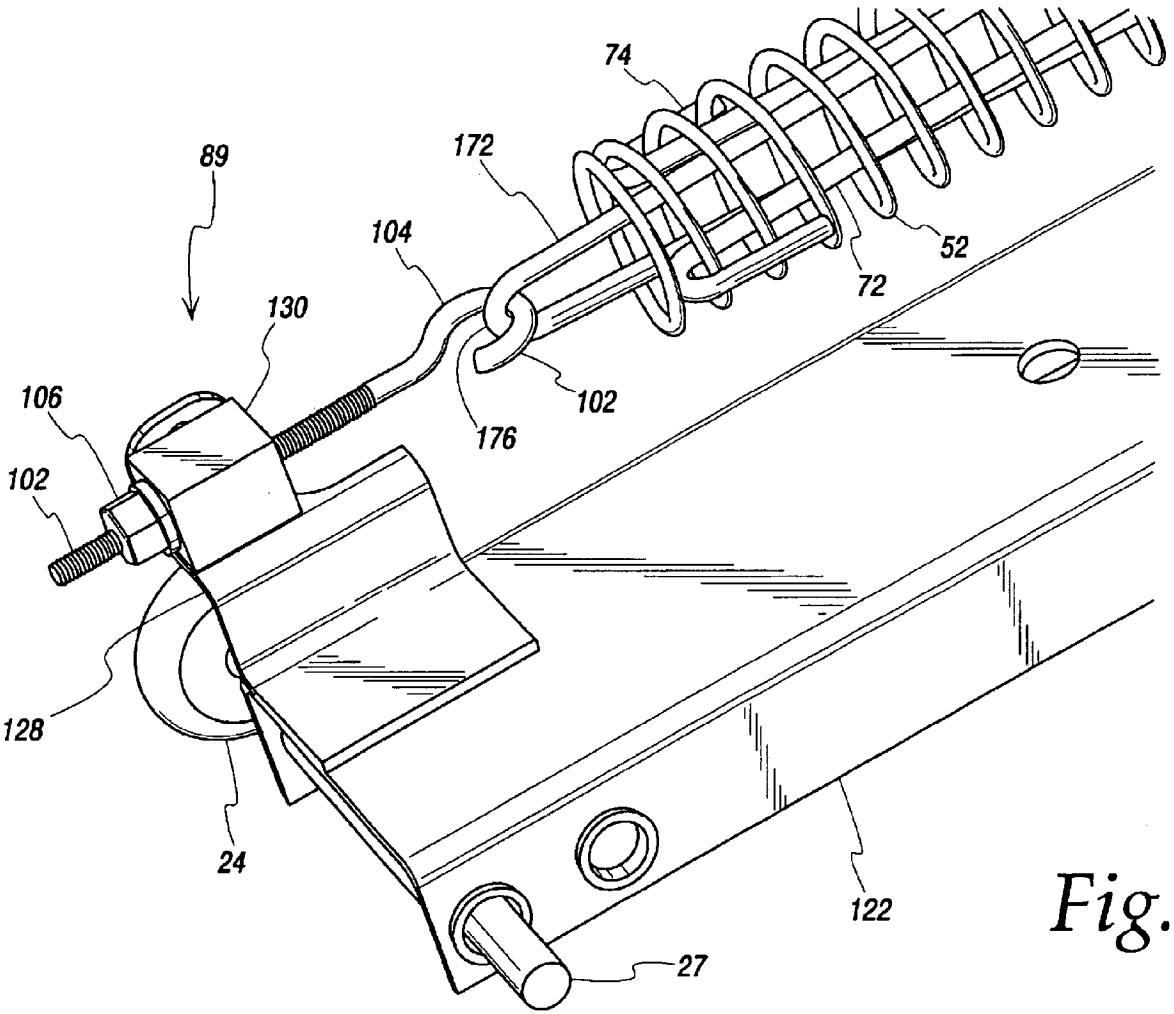
FIG. 6 is a perspective view of another preload tensioner for the drawbar spring assembly showing a hook screw threaded into a block attached to the arm pivotally connected to the upper end of the door and having one of the drawbar loops connected at the hook end for keeping the preload in the spring substantially constant during garage door operation.

FIG. 6 shows a supplemental tensioner 89, different from the tensioner 80 discussed above, that allows for the change in distance between the end of the arm 122 and the spring and drawbar assembly 50. The supplemental tensioner 89 includes a hook screw 104 having a threaded end 102 passing through a bore in a mounting block 130 fixed to the bracket 128 on the end of the arm 122. The threaded end 102 threads into a nut 106 that prevents the hook screw 104 from passing back through the bore of the block 130. The hook end 108 of the screw 104 is connected to the loop end 176 of the drawbar 172 of the spring and drawbar assembly 50. Adjustment of the nut 106 either increases or decreases the distance between the end of the arm 122 and the connection of the hook end 108 to the spring and drawbar assembly 50. When the distance is increased, the preload on the spring 52 is decreased which increases the axial travel of the spring 52 prior to full compression of the coils thereof, allowing for greater travel of the door 20 from its closed position before the spring 52 is fully compressed and the stop assembly 70 and upper cable 42 prevent further raising of the door 20. To reduce the travel of the door 20 from its closed position before further travel is prevented by the stop assembly 70 and taunt upper cable 42, the distance between the end of the arm 122 and the spring and drawbar assembly 50 is decreased, causing the hooked ends 174 of the drawbar 172 to compress the spring 52 to have a smaller initial axial length, i.e., the axial length of the spring 52 when the door 20 is fully closed.

Figure 7:
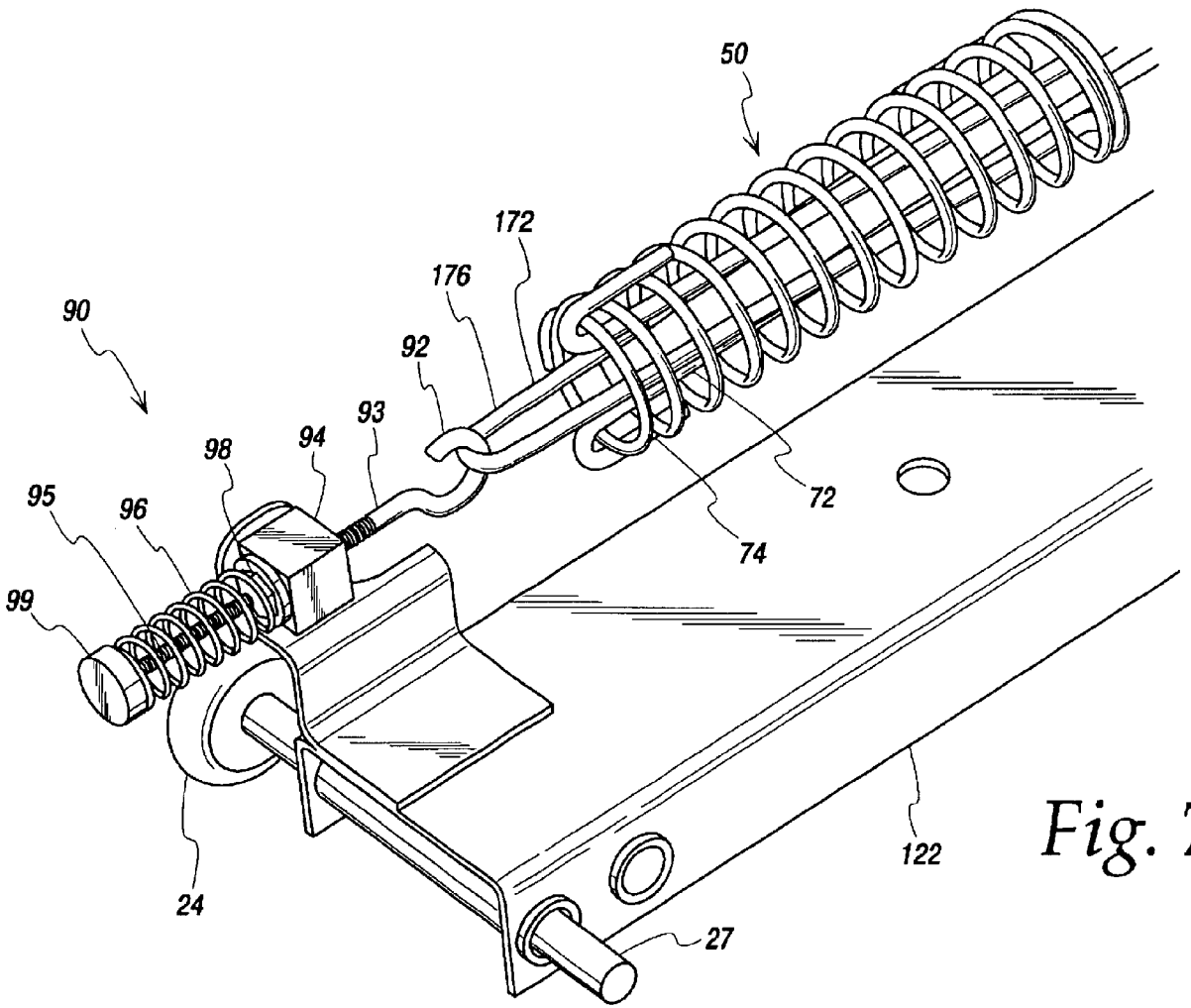
FIG. 7 is a perspective view of a self-adjusting preload tensioner for the drawbar spring assembly showing a hook screw inserted through a block attached to the arm pivotally connected to the upper end of the door and threaded into a split nut and having a spring biasing the screw from the block and having one of the drawbar loops connected at the hook end on the other side of the block for keeping the preload in the spring substantially constant during garage door operation.
Figure 8:
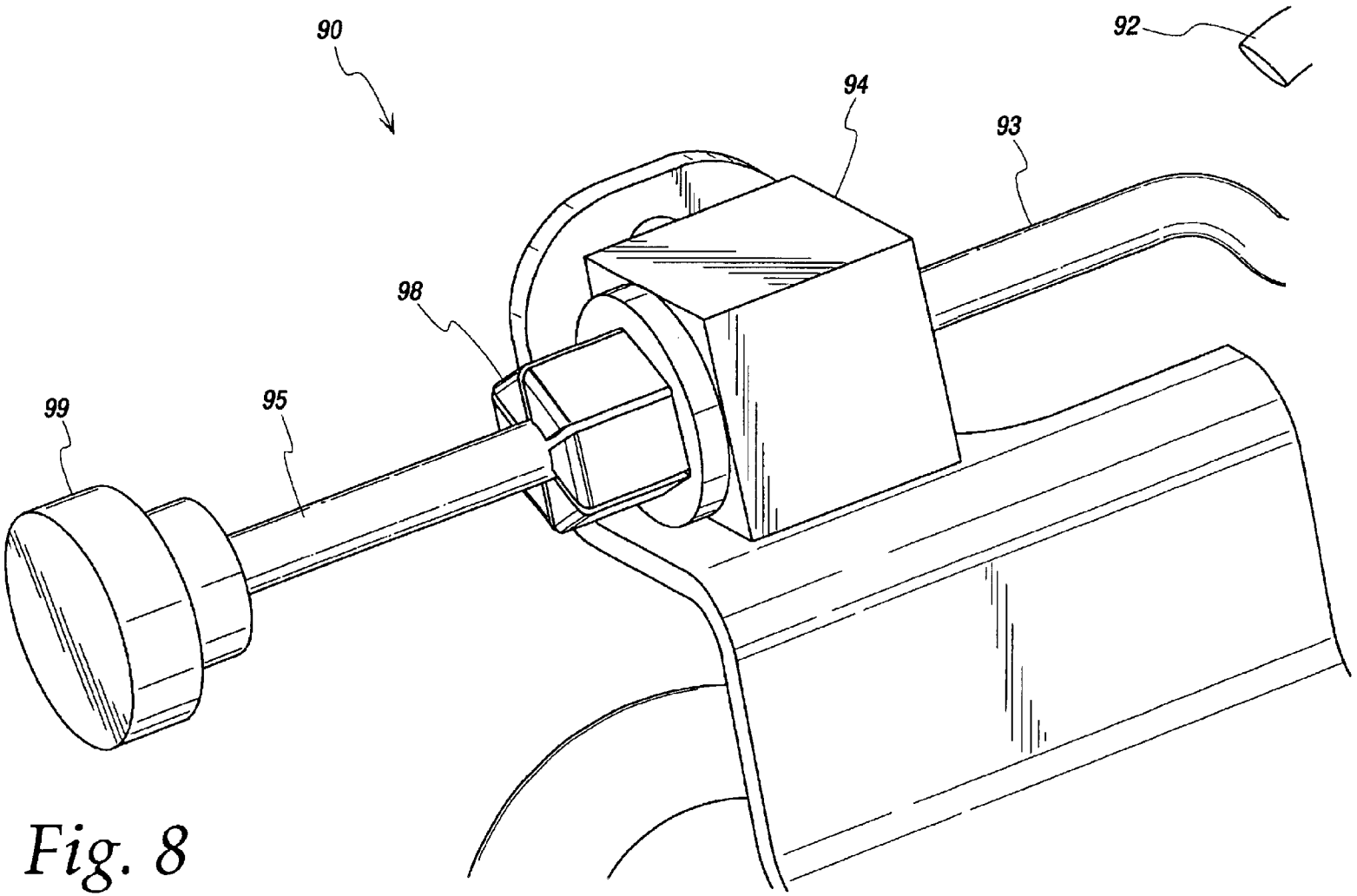
FIG. 8 is a perspective view of the self-adjusting preload tensioner of FIG. 7 with the spring removed showing the split nut and a cap on the threaded end of the hook screw against which the spring of FIG. 7 biases the screw from the block.

Another supplemental tensioner 90 is shown in FIGS. 7 and 8 for adjusting the preload in the spring 52 of the spring and drawbar assembly 50. The loop end 176 of the spring and drawbar assembly 50 is connected relative to the arm 122 via a hook screw 93. The hook screw 93 has a hook end 92 for connecting to the loop end 176 of the drawbar 172 and a threaded end 95 that passes through a bore in a block 94 mounted to the bracket 128 attached to the arm 122. A split-nut 98 generally prevents, as will be described in more detail below, the screw 93 from passing back out the bore of the block 94 when the screw 93 is pulled upon by the spring and drawbar assembly 50. The rotation of the split-nut 98 in the clockwise direction draws the hook end 92 of the screw 93 toward the end of the arm 122, thereby decreasing the distance between the end of the arm 122 and the connection between the hook end 92 of the screw 93 and the spring and drawbar assembly 50 to increase the precompression of the spring 52 which decreases the distance the opposing drawbars 72 and 172 travel to fully compress the spring 52 therebetween, such as to prevent further travel of the door 20 from the closed position absent rotation of the drive shaft 30. To increase the axial length of the preloaded spring 52, causing the drawbars 72 and 172 to travel a greater distance before the spring 52 becomes fully compressed therebetween, the split-nut 98 is turned counter-clockwise, thereby increasing the distance between the end of the arm 122 and the connection between the hook end 92 of the screw 93 and the spring and drawbar assembly 50.

In addition to being moved by rotation along the threaded portion 95 of the hook screw 93, the split-nut 98 also moves along the threaded portion 95 when the threaded portion 95 is pulled either away from or toward the mounting block 94 when a predetermined force is exceeded. The split-nut 98 functions similar to a ratchet, allowing the screw 93 to move relative to the block 94 when the predetermined force is exceeded before reengaging the threaded portion 95 thereof and preventing further movement until the predetermined force is again exceeded. A cap 99 is attached to the end of the threaded portion 95 of the screw 93 and a spring 96 is disposed between the block 94 and the cap 99 to bias the cap 99 and thus the screw 93 away from the block 94.

The biasing force of the spring 96 is selected to balance the biasing force of the spring and drawbar assembly 50 attached at the hooked end 92 of the screw 93 on the opposite side of the block 94 from the spring 96 to maintain the distance between the block 94, fixed relative to the end of the arm 122, and the connection between the hook end 92 of the screw 93 and the loop end 176 of the drawbar 172 of the spring and drawbar assembly 50 to correspond to the preloaded, precompressed axial length of the spring 52 selected to allow the spring 52 to fully compress once the maximum differential travel amount has been reached. If the spring 52 becomes axially longer than its preselected length, the biasing force of the spring 96 will be greater than the biasing force of the spring 52, and thus the spring 96 will bias the cap 99 and thus the threaded end 95 of the screw 93 from the block 94 to decrease the distance between the block 94 and the hook end 92 of the screw 93 before the spring forces are balanced and the split-nut 98 prevents further movement, thereby causing the hooks 174 of the drawbar 172 to preload and compress the spring 52 until its preselected axial length is returned. Oppositely, if the biasing force of spring 52 becomes larger than that of spring 95, such as when the spring 52 is precompressed beyond its desired preload axial length, the split-nut 98 allows the threaded portion 95 of the screw 93 to move toward the block 94 until the spring forces are balanced 96 and 52 to increase the distance between the block 94 and the hooked end 92 of the screw 93 and thus the end of the arm 122 and the connection to the spring and drawbar assembly 50, thereby allowing the spring 52 to expand back to its preselected axial length.

Turning to more of the details, the upper and lower cables 42 and 44 may wrap around the same drum 36, as illustrated in FIG. 2, or may each have separate drums 36. The drums 36 include lips 38 projecting upward on both sides thereof for assisting in preventing cable throw as the cables 42 and 44 are taken up thereby or payed out therefrom. As illustrated in FIG. 1, the upper cable 42 may be attached only on one side of the door 20. During door 20 travel, the upper cable 42 is used primarily for urging the door 20 from the open position to the closed position, and particularly the initial movement of the door 20 from its fully open position. Thus, the upper cable 42, unlike the weight bearing lower cable 44, is only necessary to be on one side of the door 20.

To assist in raising the door 20 from its closed position, the jack shaft operator 32 includes a large torsion spring 38, as illustrated in FIG. 1, that is configured to bias the door 20 from the closed position, thus reducing the amount of pulling the lower cables 44 need to do as they are taken up on the drums 36 to pull the door 20 open. When lowering the door 20, the spring 38 assists in counteracting the heavy weight of the door 20 in order to ensure a smooth, controlled descent thereof. A motor 34 is operatively connected to the jack shaft operator 32 to prevent the shaft 30 from rotating unless caused by the motor 34. When the motor 34 causes the shaft 30 to rotate in a first direction and the door 20 is in its closed position, the torsion spring 38 and the taking up of the lower cables 44 on the drums 36 causes the lifting of the door. Conversely, to move the door 20 from its fully open position, the motor 34 causes rotation of the shaft 30 in a direction opposite the first direction, taking up the upper cable 42 on the drum 36 to pull the arm 122 and thus the door 20 from the open position until the weight of the door 20 against the biasing force of the torsion spring 38 allows the controlled descent of the door 20.

The differential travel amount and the maximum differential travel amount between upper and lower cables 42 and 44 during travel of the garage door 20 between open and closed positions, discussed above, depends, at least in part, on the dimensions and geometry of the track 60 and the garage door 20. In particular, the length of the arm 122, the height of the panel sections 26, and the radius of the arcuate portion 64 of the track 60 contribute to the differential travel amounts and the maximum differential travel amount. For example, analysis has shown that an arcuate portion 64 having a fifteen inch radius and an eighteen inch arm 122 will have a larger maximum differential travel amount as compared to a twenty inch arm 122. Similarly, a different maximum differential travel differential amount will result for an arcuate portion 64 having a twelve inch radius when used with an eighteen inch arm 122 as compared to an arcuate portion 64 with a fifteen inch radius used with an eighteen inch arm 122. These particular configurations are discussed in greater detail the examples and analysis below.

EXAMPLE 1

The follow example illustrates the difference in the travel between the lower and upper cables 44 and 42 as the garage door 20 is moved from a closed position to an open position. The garage door 20 comprises four panel sections 26 hinged together with hinges 28, with each panel 26 being approximately twenty-one inches in height, for a total door height of approximately eighty-four inches. An arm 122 about twenty inches in length is pivotably connected with a bracket 124 to an upper panel 26 of the door 20 approximately six inches below its upper edge. Rollers 24 are attached to either hinges 28 or brackets 29 and 128 and extend from the lateral edges of the panels 26 and the arm 122 at positions similar to those illustrated in FIG. 1 for travel within tracks 60 having an arcuate portion 64 with a fifteen inch radius.

As the garage door 20 was move from its closed position to its open position, the length and relative travel of both the lower and upper cables 44 and 42 was measured for every twelve inches that the garage door 20 was raised from its closed position, as set forth in the table below.

15" Door Track Radius with 20" Arm

| Door Height | Lower Cable Length | Lower Cable Travel | Upper Cable Length | Upper Cable Travel | Travel Difference (Upper − Lower) |
|---|---|---|---|---|---|
| 0 | 96.127 | 0.000 | 12.311 | 0.000 | 0.000 |
| 12 | 84.122 | 12.005 | 25.072 | 12.761 | 0.756 |
| 24 | 72.117 | 24.010 | 36.753 | 24.442 | 0.432 |
| 36 | 60.110 | 36.017 | 49.207 | 36.896 | 0.879 |
| 48 | 48.099 | 48.028 | 60.981 | 48.670 | 0.642 |
| 60 | 36.078 | 60.049 | 73.789 | 61.478 | 1.429 |
| 72 | 24.043 | 72.084 | 85.477 | 73.166 | 1.082 |
| 84 | 12.167 | 83.960 | 96.506 | 84.195 | 0.235 |

Figure 9:
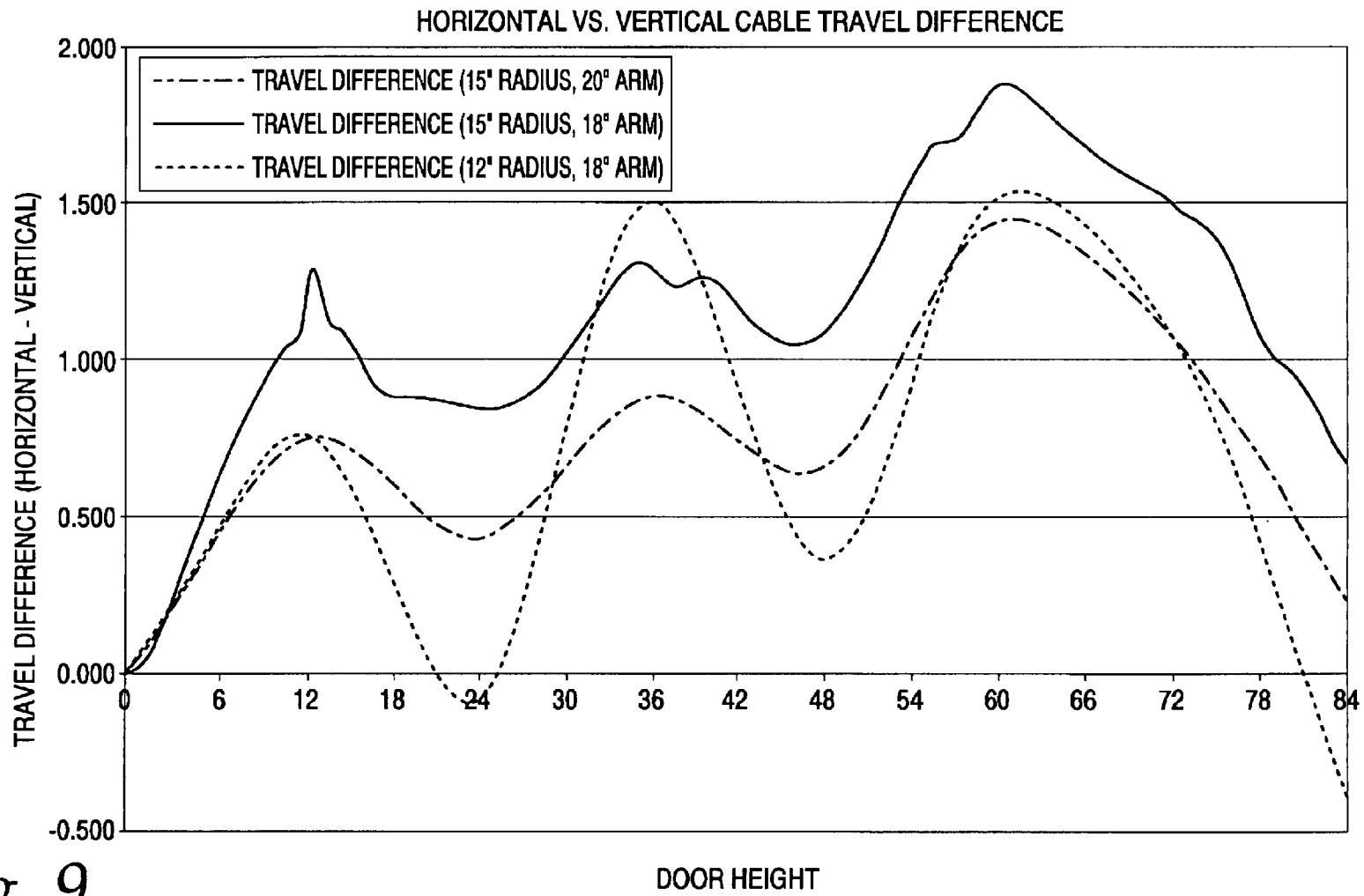
FIG. 9 is a chart comparing the differences between travel of the upper flexible cable actuator and the lower flexible cable actuator of the system of FIG. 1 to the elevation of the garage door as it travels from its closed position to its open position.

As illustrated in the chart of FIG. 9, plotting the differential travel amount between the upper and lower cables 42 and 44 in the above example relative to the height of the garage door 20 illustrates an oscillating pattern of the differential travel amount. The three peaks of the differential travel amount illustrated in FIG. 9 correspond to travel of the three sets of rollers 24 proximate the hinge connections 28 between the adjacent four panels 26 of the garage door 20 traveling through the arcuate portion 64 of the track 60. Further, as the garage door 20 is raised further, the magnitude of the differential travel amount increases due to the decrease in the distance between the lower end of the garage door 20 and the shaft 30.

The maximum difference between the upper cable travel and the lower cable travel, i.e, the maximum differential travel amount, is 1.429 inches. Thus, a tensioner 50 could be placed at an end of the upper cable 42 and adjusted to have a maximum limit of extension of 1.429 inches before further extension is prevented by the stop assembly 70, just enough extension to allow for the upper cable 42 to accommodate the variation between its travel and the travel of the lower cable 42. If desired, the limit of extension can be increased, such as to 1.50 inches, to accommodate for variations in reproducing the above results.

EXAMPLE 2

The following example is similar to EXAMPLE 1, however instead of an arm 122 twenty inches in length, an arm 122 eighteen inches in length is used. As the garage door 20 moves from its closed position to its open position, the corresponding length and differential travel between both the lower and upper cables 44 and 42 was measured for every inch the garage door 20 was raised, as set forth in the table below.

15" Door Track Radius with 18" Arm

| Door Height | Lower Cable Length | Lower Cable Travel | Upper Cable Length | Upper Cable Travel | Travel Difference (Upper − Lower) |
|---|---|---|---|---|---|
| 0 | 96.127 | 0.000 | 9.886 | 0.000 | 0.000 |
| 1 | 95.126 | 1.001 | 10.917 | 1.031 | 0.030 |
| 2 | 94.126 | 2.001 | 12.013 | 2.127 | 0.126 |
| 3 | 93.126 | 3.001 | 13.147 | 3.261 | 0.260 |
| 4 | 92.125 | 4.002 | 14.281 | 4.395 | 0.393 |
| 5 | 91.125 | 5.002 | 15.401 | 5.515 | 0.513 |
| 6 | 90.125 | 6.002 | 16.513 | 6.627 | 0.625 |
| 7 | 89.124 | 7.003 | 17.617 | 7.731 | 0.728 |
| 8 | 88.124 | 8.003 | 18.712 | 8.826 | 0.823 |
| 9 | 87.124 | 9.003 | 19.799 | 9.913 | 0.910 |

-continued

15" Door Track Radius with 18" Arm

| Door Height | Lower Cable Length | Lower Cable Travel | Upper Cable Length | Upper Cable Travel | Travel Difference (Upper − Lower) |
|---|---|---|---|---|---|
| 10 | 86.123 | 10.004 | 20.876 | 10.990 | 0.986 |
| 11 | 85.123 | 11.004 | 21.940 | 12.054 | 1.050 |
| 12 | 84.122 | 12.005 | 22.990 | 13.104 | 1.099 |
| 13 | 83.122 | 13.005 | 24.200 | 14.314 | 1.309 |
| 14 | 82.122 | 14.005 | 25.025 | 15.139 | 1.134 |
| 15 | 81.121 | 15.006 | 25.989 | 16.103 | 1.097 |
| 16 | 80.121 | 16.006 | 26.903 | 17.017 | 1.011 |
| 17 | 79.121 | 17.006 | 27.820 | 17.934 | 0.928 |
| 18 | 78.120 | 18.007 | 28.788 | 18.902 | 0.895 |
| 19 | 77.120 | 19.007 | 29.785 | 19.899 | 0.892 |
| 20 | 76.120 | 20.007 | 30.781 | 20.895 | 0.888 |
| 21 | 75.119 | 21.008 | 31.776 | 21.890 | 0.882 |
| 22 | 74.119 | 22.008 | 32.768 | 22.882 | 0.874 |
| 23 | 73.118 | 23.009 | 33.758 | 23.872 | 0.863 |
| 24 | 72.118 | 24.009 | 34.750 | 24.864 | 0.855 |
| 25 | 71.117 | 25.010 | 35.746 | 25.860 | 0.850 |
| 26 | 70.117 | 26.010 | 36.751 | 26.865 | 0.855 |
| 27 | 69.116 | 27.011 | 37.767 | 27.881 | 0.870 |
| 28 | 68.116 | 28.011 | 38.795 | 28.909 | 0.898 |
| 29 | 67.115 | 29.012 | 39.838 | 29.952 | 0.940 |
| 30 | 66.115 | 30.012 | 40.892 | 31.006 | 0.994 |
| 31 | 65.114 | 31.013 | 41.954 | 32.068 | 1.055 |
| 32 | 64.114 | 32.013 | 43.020 | 33.134 | 1.121 |
| 33 | 63.113 | 33.014 | 44.088 | 34.202 | 1.188 |
| 34 | 62.113 | 34.014 | 45.154 | 35.268 | 1.254 |
| 35 | 61.112 | 35.015 | 46.202 | 36.316 | 1.301 |
| 36 | 60.111 | 36.016 | 47.204 | 37.318 | 1.302 |
| 37 | 59.111 | 37.016 | 48.161 | 38.275 | 1.259 |
| 38 | 58.110 | 38.017 | 49.129 | 39.243 | 1.226 |
| 39 | 57.110 | 39.017 | 50.145 | 40.259 | 1.242 |
| 40 | 56.109 | 40.018 | 51.161 | 41.275 | 1.257 |
| 41 | 55.109 | 41.018 | 52.143 | 42.257 | 1.239 |
| 42 | 54.108 | 42.019 | 53.096 | 43.210 | 1.191 |
| 43 | 53.107 | 43.020 | 54.041 | 44.155 | 1.135 |
| 44 | 52.106 | 44.021 | 54.996 | 45.110 | 1.089 |
| 45 | 51.104 | 45.023 | 55.966 | 46.080 | 1.057 |
| 46 | 50.102 | 46.025 | 56.952 | 47.066 | 1.041 |
| 47 | 49.101 | 47.026 | 57.956 | 48.070 | 1.044 |
| 48 | 48.099 | 48.028 | 58.980 | 49.094 | 1.066 |
| 49 | 47.098 | 49.029 | 60.022 | 50.136 | 1.107 |
| 50 | 46.097 | 50.030 | 61.085 | 51.199 | 1.169 |
| 51 | 45.096 | 51.031 | 62.162 | 52.276 | 1.245 |
| 52 | 44.095 | 52.032 | 63.251 | 53.365 | 1.333 |
| 53 | 43.094 | 53.033 | 64.346 | 54.460 | 1.427 |
| 54 | 42.091 | 54.036 | 65.445 | 55.559 | 1.523 |
| 55 | 41.090 | 55.037 | 66.531 | 56.645 | 1.608 |
| 56 | 40.088 | 56.039 | 67.602 | 57.716 | 1.677 |
| 57 | 39.086 | 57.041 | 68.615 | 58.729 | 1.688 |
| 58 | 38.084 | 58.043 | 69.637 | 59.751 | 1.708 |
| 59 | 37.081 | 59.046 | 70.713 | 60.827 | 1.781 |
| 60 | 36.078 | 60.049 | 71.788 | 61.902 | 1.853 |
| 61 | 35.075 | 61.052 | 72.817 | 62.931 | 1.879 |
| 62 | 34.072 | 62.055 | 73.804 | 63.918 | 1.863 |
| 63 | 33.069 | 63.058 | 74.768 | 64.882 | 1.824 |
| 64 | 32.066 | 64.061 | 75.727 | 65.841 | 1.780 |
| 65 | 31.063 | 65.064 | 76.687 | 66.801 | 1.737 |
| 66 | 30.060 | 66.067 | 77.650 | 67.764 | 1.697 |
| 67 | 29.057 | 67.070 | 78.614 | 68.728 | 1.658 |
| 68 | 28.054 | 68.073 | 79.582 | 69.696 | 1.623 |
| 69 | 27.051 | 69.076 | 80.555 | 70.669 | 1.593 |
| 70 | 26.048 | 70.079 | 81.530 | 71.644 | 1.565 |
| 71 | 25.045 | 71.082 | 82.505 | 72.619 | 1.537 |
| 72 | 24.043 | 72.084 | 83.480 | 73.594 | 1.510 |
| 73 | 23.038 | 73.089 | 84.443 | 74.557 | 1.468 |
| 74 | 22.051 | 74.076 | 85.401 | 75.515 | 1.439 |
| 75 | 21.073 | 75.054 | 86.346 | 76.460 | 1.406 |
| 76 | 20.089 | 76.038 | 87.264 | 77.378 | 1.340 |
| 77 | 19.103 | 77.024 | 88.138 | 78.252 | 1.228 |
| 78 | 18.114 | 78.013 | 88.995 | 79.109 | 1.096 |
| 79 | 17.126 | 79.001 | 89.897 | 80.011 | 1.010 |
| 80 | 16.138 | 79.989 | 90.843 | 80.957 | 0.968 |
| 81 | 15.140 | 80.987 | 91.792 | 81.906 | 0.919 |
| 82 | 14.147 | 81.980 | 92.710 | 82.824 | 0.844 |

-continued

15" Door Track Radius with 18" Arm

| Door Height | Lower Cable Length | Lower Cable Travel | Upper Cable Length | Upper Cable Travel | Travel Difference (Upper − Lower) |
|---|---|---|---|---|---|
| 83 | 13.153 | 82.974 | 93.608 | 83.722 | 0.748 |
| 84 | 12.167 | 83.960 | 94.506 | 84.620 | 0.660 |

When the differential travel amount between the upper and lower cables 42 and 44 is plotted against the elevation of the bottom end of the garage door 20, as illustrated in FIG. 9, an oscillation pattern similar to that of EXAMPLE 1 is apparent. However, by shortening the arm length compared to that of EXAMPLE 1, the maximum variation between the cable travels is increased to 1.879 inches. Accordingly, the biasing mechanism 50 could be placed at an end of the upper cable 42 and have the stop assembly 70 configured to provide a maximum extension limit of 1.879 inches, corresponding to the maximum travel differential amount between the cables 42 and 44.

EXAMPLE 3

The following example is similar to EXAMPLES 1 and 2, however an arm 122 eighteen inches in length and a track 60 having an arcuate portion 64 with a radius of twelve inches are used. As the garage door 20 was move from its closed position to its open position, the corresponding length and travel of both the lower and upper cables 44 and 42 was measured for every twelve inches the door 20 was raised, as set forth in the table below.

12" Door Track Radius with 18" Arm

| Door Height | Lower Cable Length | Lower Cable Travel | Upper Cable Length | Upper Cable Travel | Travel Difference (Upper − Lower) |
|---|---|---|---|---|---|
| 0 | 96.127 | 0.000 | 12.391 | 0.000 | 0.000 |
| 12 | 84.122 | 12.005 | 25.166 | 12.775 | 0.770 |
| 24 | 72.117 | 24.010 | 36.326 | 23.935 | −0.075 |
| 36 | 60.110 | 36.017 | 49.906 | 37.515 | 1.498 |
| 48 | 48.099 | 48.028 | 60.771 | 48.380 | 0.352 |
| 60 | 36.078 | 60.049 | 73.938 | 61.547 | 1.498 |
| 72 | 24.043 | 72.084 | 85.563 | 73.172 | 1.088 |
| 84 | 12.167 | 83.960 | 95.962 | 83.571 | −0.389 |

When the differential travel amount for the upper and lower cables 42 and 44 of EXAMPLE 3 is plotted against the garage door elevation, an oscillation pattern similar to that of EXAMPLES 1 and 2 is apparent. However, the change in the radius of the arcuate portion 64 of the track 60, as compared to EXAMPLES 1 and 2, and the arm length, as compared to EXAMPLE 1, combine to result in a maximum travel difference of 1.498 inches. Thus, a biasing mechanism 50 having a stop assembly 70 configured to allow for a maximum of 1.498 inches of movement, corresponding to the maximum travel difference, can be placed the upper cable 42 and the top end of the garage door 20.

Figure 10:
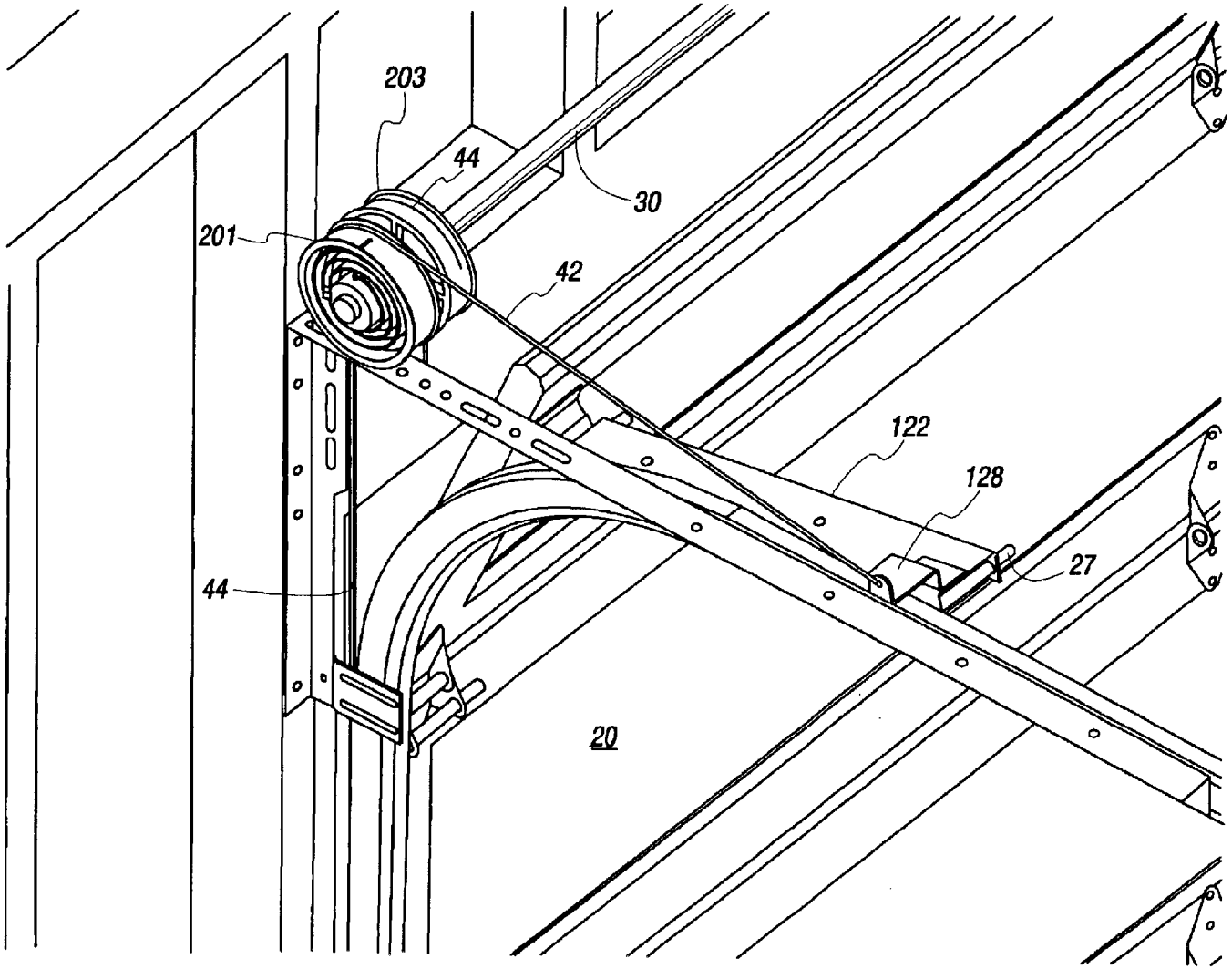
FIG. 10 is a perspective view of a barrier movement system including a torsion drum.
Figure 12:
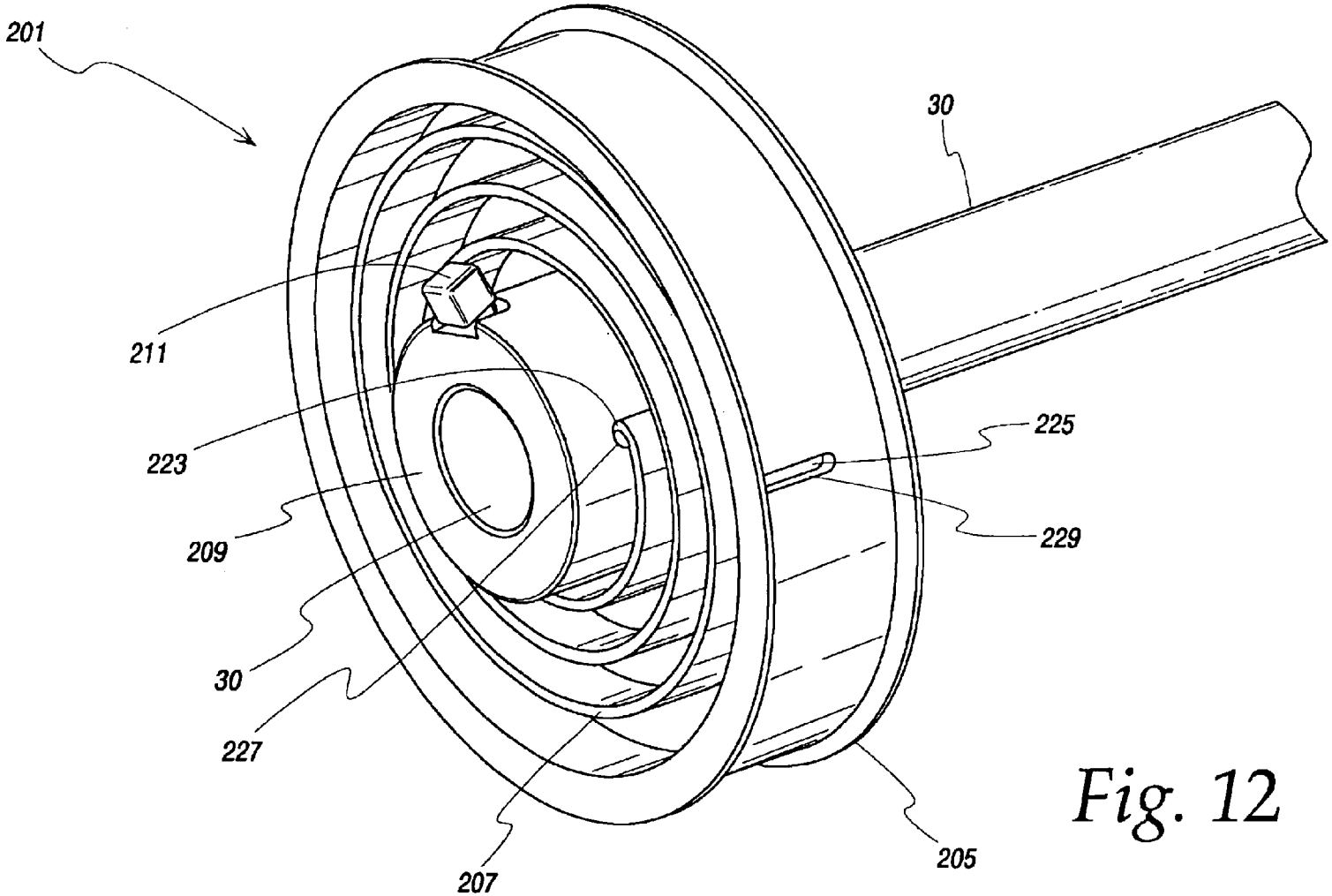
FIG. 12 is a perspective view of an assembled torsion drum mounted on a sectioned drive shaft.
Figure 13:
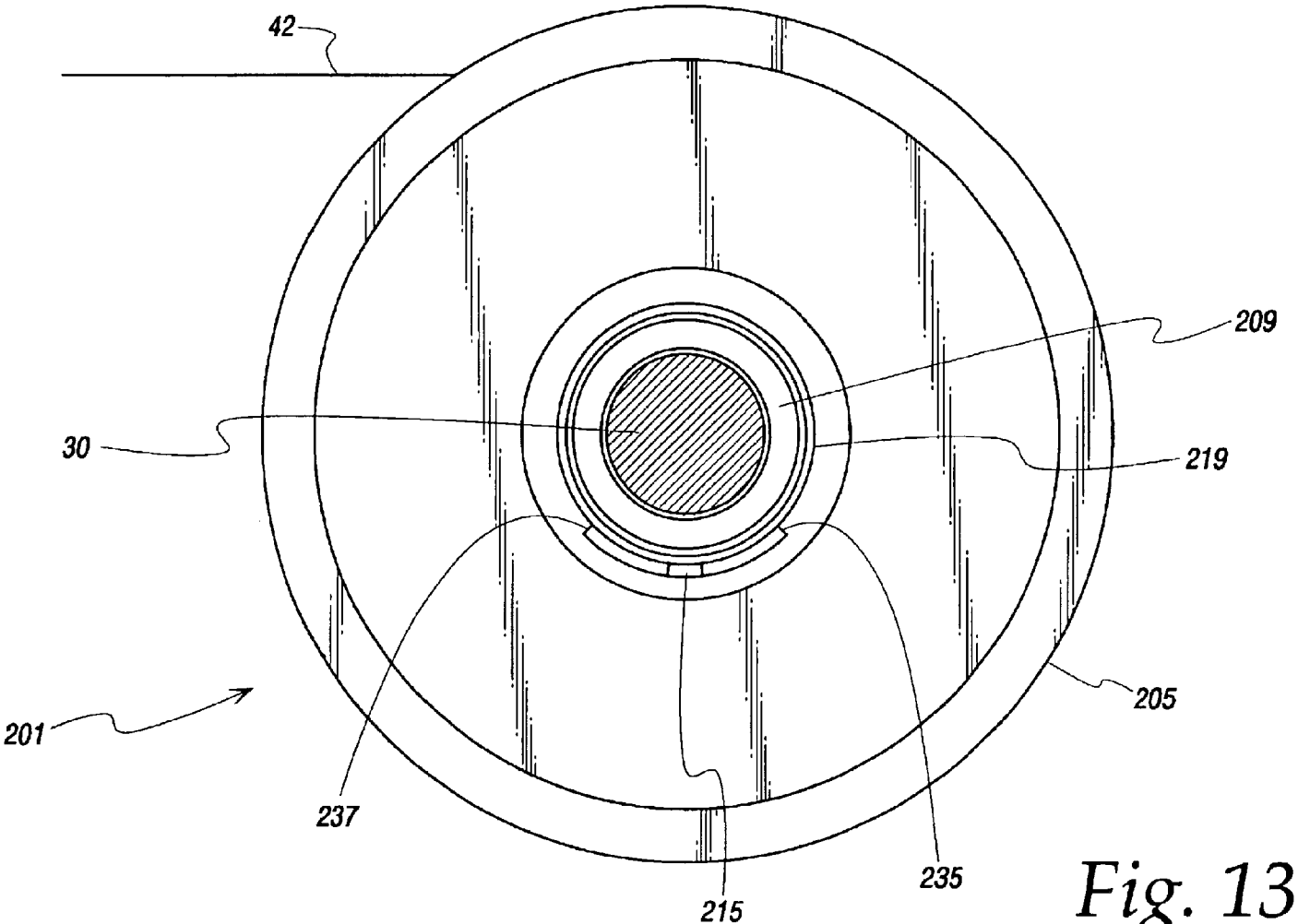
FIG. 13 is a plain view of a back side of the torsion drum of FIGS. 10–12.

FIG. 10 is a perspective view of an embodiment employing a torsion drum 201 as a biasing mechanism. The embodiment of FIG. 10 uses a pair of cable drums 201 and 203. Drum 203 is connected to one end of a cable 44, the other end of which is attached to the door 20 as previously described. Drum 203 is attached to fixedly rotate with drive shaft 30 to raise and lower the door 20 from a bottom connection thereto. Torsion drum 201 which is shown in greater detail in FIGS. 11–13 is mounted to rotate with drive shaft 30, but the forces of rotation of shaft 30 are conveyed to a drum portion 205 of torsion drum 201 by a torsion spring 207.

Figure 11:
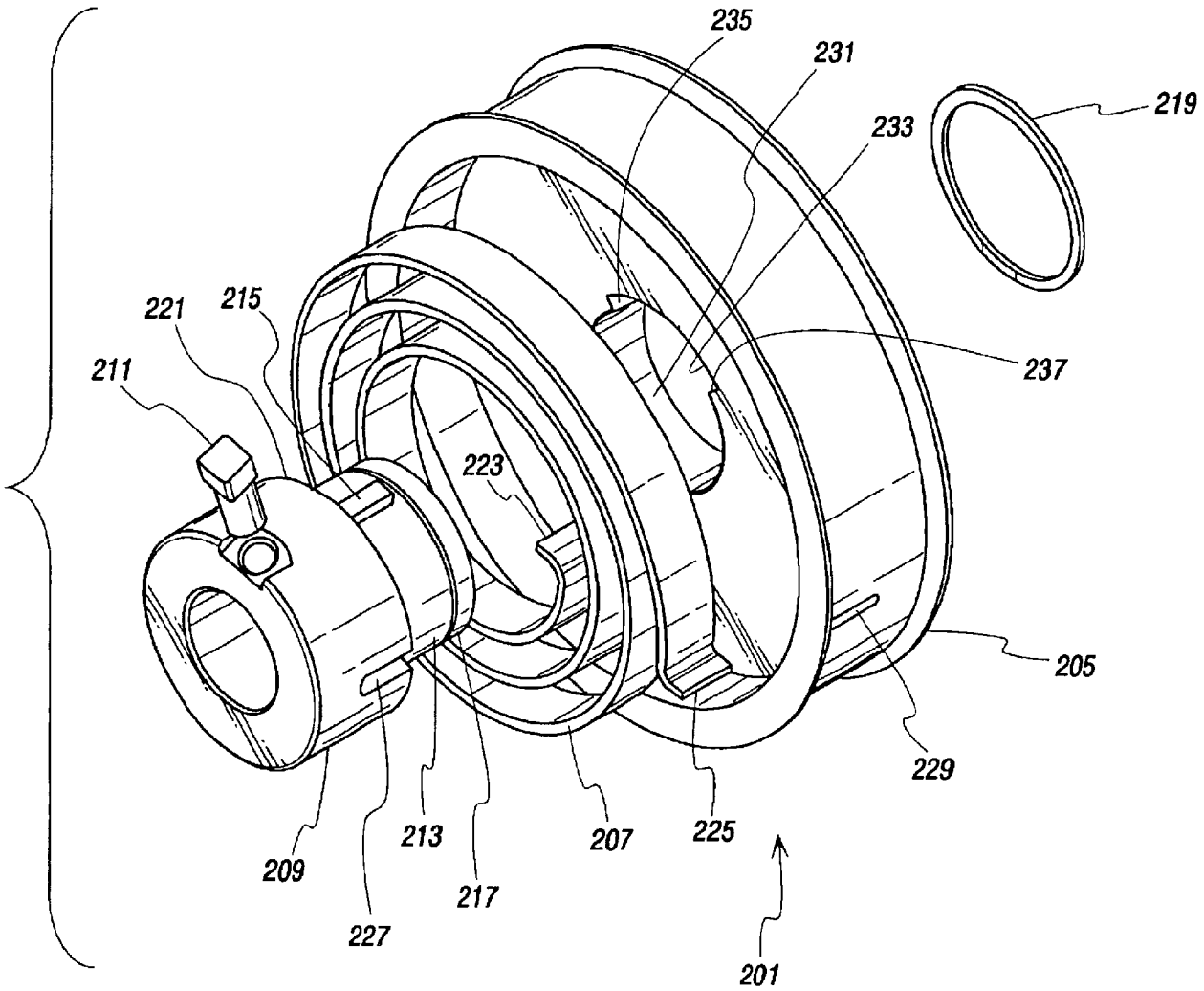
FIG. 11 is an exploded perspective view of a torsion drum.

FIG. 11 shows the torsion drum 201 in exploded view. The torsion drum 201 is affixed to drive shaft 30 by a collar 209 with a set screw 211. When the set screw is tightened against the drive shaft 30 the collar rotates with the drive shaft. The drum portion 205 includes a cylindrical opening 231 which is disposed about a reduced diameter portion 213 of collar 209 and is free to rotate about the reduced diameter portion. The reduced diameter portion 213 of collar 209 includes a groove 217 around its circumference. When the drum portion 205 is placed over the reduced diameter portion 213, a snap-ring 219 is fitted into groove 217 and retains drum portion 205 between snap-ring 219 and a lip 221 of collar 209.

Spring 207 includes an inner end 223 which is connected to collar 209 and an outer end 225 which is attached to drum portion 205. In the embodiment of FIGS. 11–13 inner end 223 is inserted into a slot 227 of collar 209 and outer end 225 is inserted into a slot 229 on the circumference of drum portion 205 during assembly.

The reduced diameter portion 213 of collar 209 includes a raised portion or stop 215 which is inserted into a slot formed by an increased diameter portion 233 of cylindrical opening 231. The increased diameter portion 233 ends at two abutment surfaces 235 and 237 where the diameter transitions back to the non-increased diameter. After collar is affixed to drive shaft 30 the abutment surfaces 235 and 237 and stop 215 limit the resilient rotation of hub portion 205 with respect to the drive shaft. FIG. 12 shows a perspective view of torsion hub 201 as assembled and includes a sectioned view of drive shaft 30 in place. FIG. 13 is a plan view of torsion drum 201 from the reverse side. Spring 207 is selected to have a spring constant which, provides the same advantages as biasing mechanism 50 of the embodiments of FIGS. 1–8. In operation the torsion drum 201 provides resilient take up and pay out of cable 42 as the door 20 is raised and lowered.

Figure 15:
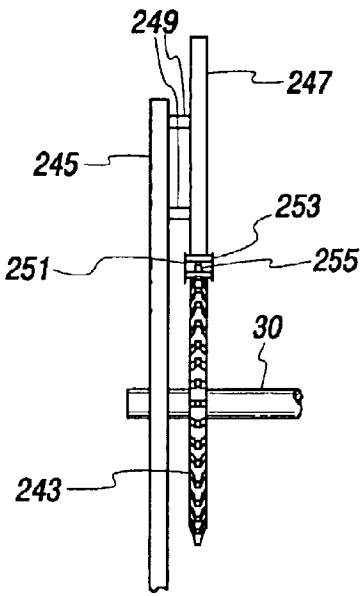
FIG. 15 is a view of a sprocket, chain and chain guide of FIG. 14.
Figure 14:
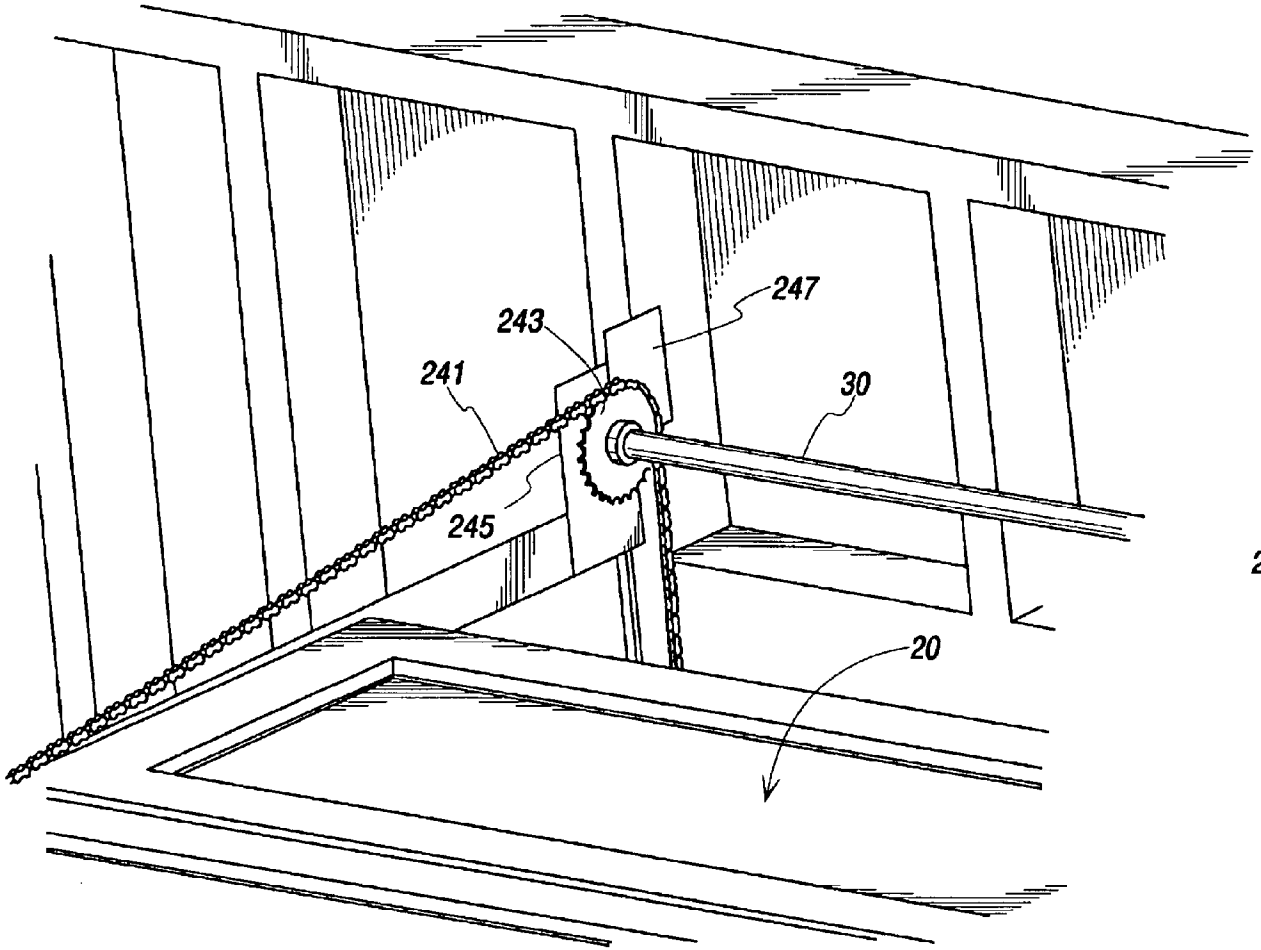
FIG. 14 is a perspective view of a barrier movement system having a chain as a flexible actuator.

FIG. 14 illustrates the use of a chain 241 as a flexible actuator for raising and lowering a barrier 20. In FIG. 14, the drum attached to drive shaft 30 comprises a sprocket 243 which is fixed to the rotation of the drive shaft. Chain 241 has one end (not shown) attached near the bottom of door 20 as was cable portion 44 in the embodiment of FIG. 1. A second end of chain 241 is connected to door 20 by means of an arm 122 as shown in FIG. 1. Further, the connection between the second end of chain 241 and arm 122 is completed with a biasing mechanism such as previously discussed biasing mechanism 50. The chain 241 is continuous between its ends and a moving center portion of the chain is in driving contact with sprocket 243. Optionally, a guide 247 may be provided which maybe useful to keep the chain in contact with sprocket 243. FIG. 15 represents an end view of the chain 241, sprocket 243 and chain guide 247. In FIG. 15 chain guide fits into the space between side links 251 and 253 of chain 241 and rides near the roller pins 255 thereof. Guide 247 is held in place by separators 249 connected to the support member 245 of drive shaft 30.

Figure 16:
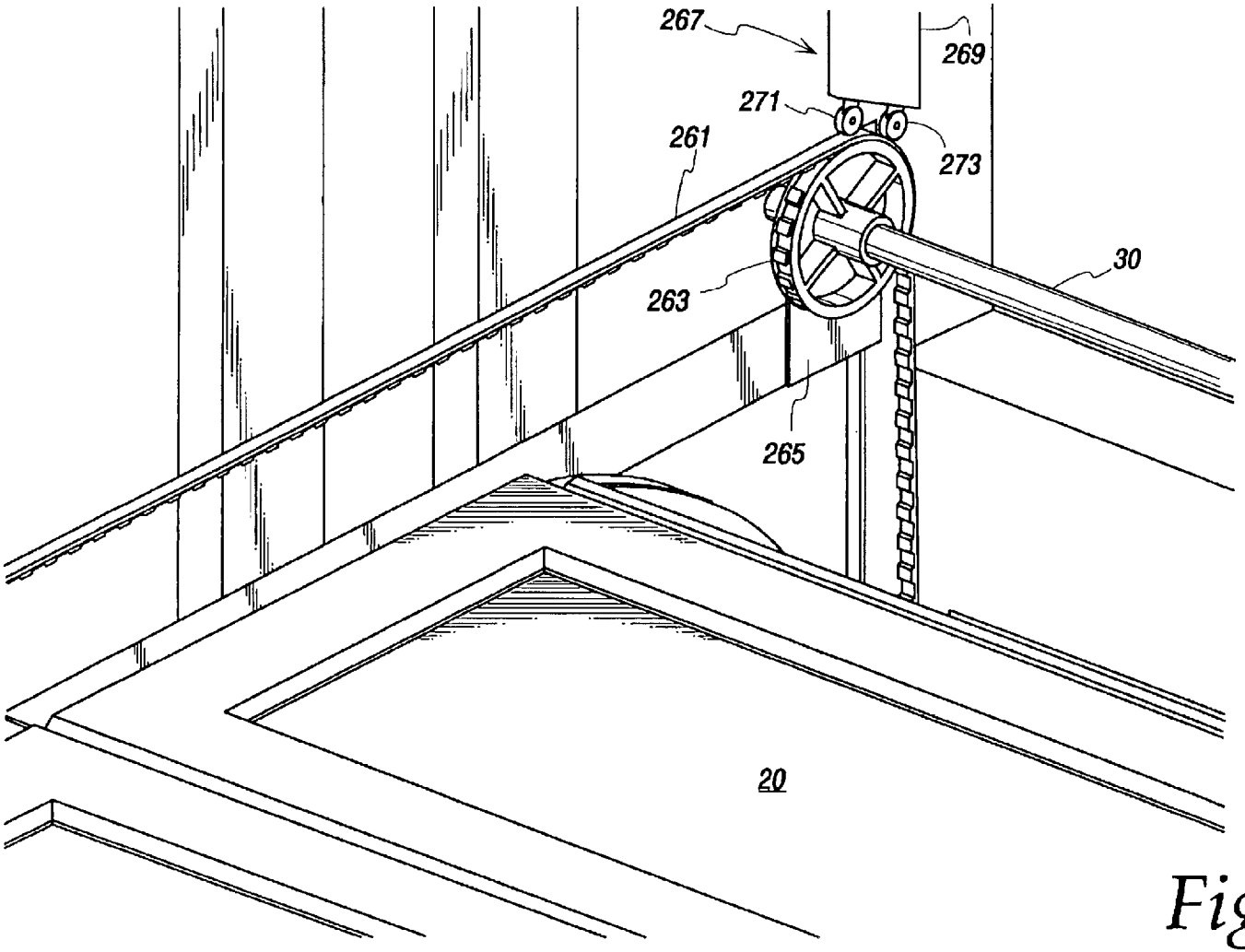
FIG. 16 is a perspective view of a barrier movement system having a belt as a flexible actuator.

FIG. 16 shows an example of a belt 261 being used as a flexible actuator for raising and lowering a barrier 20. In FIG. 16 belt 261 is a toothed belt to prevent slippage between a pulley 263 and the belt. Belt 261 has a first and a second end and is substantially continuous therebetween. The first end of belt 261 is connected to barrier 20 at a point near the bottom thereof. The second end of belt 261 is connected to barrier 20 by means of an arm 122 and biasing mechanism 50. The toothed pulley 263 is fixed to drive shaft 30 for rotation therewith. Optionally, a belt engagement apparatus 267 may be provided to retain contact between belt 261 and pulley 263. Belt engagement apparatus comprises a support 269 and a pair of rollers 271 and 273 which are held against belt 261 pressing it onto pulley 263. The rollers 271 and 273 may be spring biased to maintain relatively constant contact pressure on belt 261.

While there have been illustrated and described particular embodiments of the present invention, it will be appreciated that numerous changes and modifications will occur to those skilled in the art, and it is intended in the appended claims to cover all those changes and modifications which fall within the true spirit and scope of the present invention.

The invention is defined more particularly by the following claims:

What is claimed is:

1. A movable barrier system comprising:

a moveable barrier shiftable between open and closed positions;

a drive shaft driven for rotation to shift the barrier between one of the open and closed positions to the other of the open and closed positions;

an actuator assembly including a flexible actuator connected between the drive shaft and the barrier for shifting the barrier from the one position to the other upon rotation of the drive shaft;

a biasing mechanism including a resilient biasing member between the flexible actuator and the barrier that exerts a generally linear biasing force in a predetermined linear direction for keeping the flexible actuator tensioned as the barrier is shifted; and a stop assembly of the biasing mechanism that keeps resilient flexing of the biasing member and shifting of the barrier absent drive shaft rotation from the other position toward the one position to a predetermined limited amount, the stop assembly including connections to the biasing member to resiliently flex the member along the linear direction upon shifting of the barrier absent drive shaft rotation, and the resilient biasing member comprises a compression spring, and the stop assembly includes a pair of pull devices with one of the pull devices operatively connected to the flexible actuator and the other of the pull devices operatively connected to the barrier, the pull devices and compression spring being configured to compress the spring therebetween when the barrier is shifted from the closed position toward the open position absent drive shaft rotation until the barrier reaches the predetermined limited amount of shifting.

2. A movable barrier system of claim 1 wherein the stop assembly includes connections to the biasing member to resiliently flex the member along the linear direction upon shifting of the barrier absent drive shaft rotation.

3. A movable barrier system of claim 1 wherein the barrier is a garage door having a generally horizontal open position and a generally vertical closed position, the flexible actuator is a pull cable that pulls the garage door from the open to the closed position thereof with the linear direction of the biasing force exerted by the biasing member generally being aligned with the cable.

4. A movable barrier system of claim 3 wherein the drive shaft is a jack shaft having a drum mounted for rotation therewith with the pull cable having one end attached adjacent an upper end of the door and the other end attached to the drum so that rotation of the jack shaft, causing the cable to be taken upon the drum, pulls the door from the horizontal open position toward the vertical closed position, and the predetermined limited amount of door shifting is a short vertical distance.

5. A movable barrier system of claim 4 wherein the short vertical distance of the door is approximately two inches.

6. A movable barrier system of claim 1 wherein the flexible actuator shifts the barrier from the open position to the closed position upon drive shaft rotation in a predetermined rotational direction, and the predetermined limited amount of shifting of the barrier from the closed position toward the open position allowed by the stop assembly is a predetermined distance that is of sufficiently small size to substantially prevent unauthorized entry into a space closed off by the barrier in its closed position.

7. A movable barrier system of claim 1 wherein the stop assembly allows the biasing member to flex by a predetermined amount corresponding to the predetermined limited about of allowed barrier shifting, and the biasing mechanism includes a supplemental tensioner that keeps tension in the flexible actuator so that the predetermined amount of flexing of the biasing member allowed by the stop assembly remains generally the same.

8. A movable barrier of claim 7 wherein the biasing mechanism comprises a compression spring having a substantially fully compressed state cooperating with the stop assembly to provide the predetermined limited amount of barrier shifting.

9. A movable barrier system comprising:

a moveable barrier shiftable between open and closed positions;

a drive shaft driven for rotation to shift the barrier between one of the open and closed positions to the other of the open and closed positions;

an actuator assembly including a flexible actuator connected between the drive shaft and the barrier for shifting the barrier from the one position to the other upon rotation of the drive shaft, the flexible actuator extending between an end of the barrier and the drive shaft and another flexible actuator extending between an opposite end of the barrier and the drive shaft, the flexible actuators undergoing different relative travel amounts to define a travel differential therebetween that varies up to a maximum differential travel amount as the barrier is shifted between the open and closed positions;

a biasing mechanism including a resilient biasing member between the flexible actuator and the barrier that exerts a generally linear biasing force in a predetermined linear direction for keeping the flexible actuator tensioned as the barrier is shifted; and a stop assembly of the biasing mechanism that keeps resilient flexing of the biasing member and shifting of the barrier absent drive shaft rotation from the other position toward the one position to a predetermined limited amount, the biasing mechanism having the stop assembly arranged to allow the biasing mechanism to take-up the maximum differential travel amount so that the maximum differential travel amount substantially corresponds to the predetermined limited amount of barrier shifting allowed by the biasing mechanism and stop assembly.

10. A system of claim 9 wherein the biasing mechanism includes an adjustment device connected to the stop assembly to allow the biasing mechanism to be tailored to take up varying differential travel amounts for keeping the predetermined limited amount of barrier shifting to a minimum.

11. A system for shifting a moveable barrier between predetermined positions, the drive system comprising:

a first flexible actuator adopted to be operably connected to the barrier to shift the barrier from a first one of the predetermined positions to a second one of the predetermined positions;

a second flexible actuator adopted to be operably connected to the barrier to shift the barrier from the second predetermined position to the first predetermined position, the first and second flexible actuators undergoing different travel amounts relative to each other to define a travel differential therebetween that varies up to a maximum differential as the barrier is shifted between the predetermined positions thereof;

a resilient take-up device associated with the first flexible actuator that provides a bias force to the first actuator by a resilient deflection thereof to minimize slack in the first actuator due to the actuator travel differential during barrier shifting; and a limit assembly of the take-up device which defines a predetermined maximum level of deflection of the take-up device to avoid overflexing thereof and allowing the predetermine maximum deflection level of the take-up device to be preselected to generally correspond to the maximum actuator travel differential for keeping the predetermined maximum deflection level to a minimum.

12. A system of claim 11 wherein the resilient take-up device comprises a compression coil spring and the limit assembly includes a compression member adopted to be operably connected to the barrier to compress the spring for causing the resilient deflection thereof.

13. A system of claim 11 in combination with a barrier comprising a multi-panel garage door including a plurality of hinged together panels, the first position is a vertical closed position and the second position is a horizontal open position, and the first and second flexible actuators are closing and opening actuators, respectively, and including a guide track having vertical and horizontal portions and an arcuate transition portion interconnecting the vertical and horizontal portions with the panels pivoting with respect to adjacent panels during travel along the arcuate track portion causing the travel differential between the opening and closing flexible actuators.

14. A system of claim 13 wherein with the door in the vertical closed position the opening flexible actuator is connected to one of the door panels adjacent a lower end of the door and the closing flexible actuator is connected to another one of the door panels adjacent an upper end of the door, the closing flexible actuator generally travels by a variable greater amount than the opening flexible actuator during door shifting, and the resilient take-up device is associate with the closing flexible actuator to take up the greater amount of travel thereof.

15. A system of claim 11 wherein the first flexible actuator is adopted to generally travel by a variable greater amount than the second flexible actuator so that the resilient take-up device associate therewith removes the slack therein otherwise generated by the greater travel thereof.

16. A system of claim 11 wherein the take-up device includes an adjustment member connected to the limit assembly to allow the predetermined maximum flex level of the take-up device to be tailored to different maximum travel differentials.

17. A system of claim 11 in combination with a barrier comprising a garage door having a vertical closed position to close off a space therebehind and a horizontal open position, and a drive shaft driven for rotation to cause travel of the flexible actuators and shifting of the door with the resilient take-up device and limit assembly thereof only allowing a predetermined limited amount of door shifting from the vertical closed position thereof absent drive shaft rotation with the limited amount corresponding to the maximum deflection level of the resilient take-up device and being of sufficiently small size to prevent unauthorized entry into the closed off space behind the door.

18. A system of claim 11 including a drive shaft and at least one drum member mounted thereto for rotation therewith and at least the first flexible actuator comprises a cable that spools onto and pays out from the drum member as the drive shaft rotates with the resilient take-up device keeping the cable tensioned to minimize cable throw from the drum.

19. A system of claim 18 wherein the drum comprises a collar portion connected to the drive shaft, a drum portion connected for take up and pay out of the flexible actuator and a resilient take-up device connecting the collar portion to the drum portion.

20. A system of claim 19 comprising a stop assembly portion for limiting movement of the drum portion with respect to the collar portion.

21. A system of claim 19 wherein the resilient take-up device comprising a torsion spring.

22. A system of claim wherein 11 the first and second flexible actuators are distinct actuator members.

23. A drive system for a moveable barrier that is shifted between open and closed positions, the drive system comprising:

a drive shaft driven for rotation and adopted for connection to a barrier to shift the barrier between one of the open and closed positions to the other of the open and closed positions;

a drum assembly including a drum mounted for rotation with the drive shaft and allowing a predetermined amount of relative rotation therebetween;

an actuator assembly including a flexible actuator connected between the drum and the barrier for shifting the barrier from the one position to the other upon rotation of the drive shift, the flexible actuator being taken upon the drum during shifting from the one position to the other position and being taken from the drum during shifting from the other position to the one position;

a biasing mechanism including a resilient biasing member operatively connected between the drum and the drive shift that exerts a biasing force for keeping the flexible actuator tensioned as the barrier is shifted; and a stop mechanism of the drum assembly that limits shifting of the barrier absent drive shaft rotation from the other position toward the one position to a predetermined limited amount corresponding the predetermined amount of relative rotation between the drum and the drive shaft and wherein the of flexible actuator extends between an end of the barrier and the drum and another flexible actuator extends between an opposite end of the barrier and the drive shaft, and the flexible actuators undergo different relative travel amounts to define a travel differential therebetween that varies up to a maximum differential travel amount as the barrier is shifted between the open and closed positions, and the drum assembly has the stop mechanism arranged to allow the biasing mechanism to take-up the maximum differential travel amount so that the maximum differential travel amount substantially corresponds to the predetermined limited amount of barrier shifting allowed by the predetermined amount of relative rotation between the drum and the drive shaft.

24. A system of claim 23 wherein the resilient biasing member comprises a torsion power spring.

25. A system of claim 23 wherein the resilient biasing member comprises a spring, and the stop mechanism comprises an abutment surface on the drum being configured to contact an abutment member generally fixed relative to the shaft when the barrier is shifted from the close position toward the open position absent drive shaft rotation an the barrier reaches the predetermined limited amount of shifting to restrict further shifting of the barrier.

26. A system of claim 25 wherein the drum assembly is configured so that the abutment surface and the abutment member contact after less than about 90 degrees of relative rotation between the drum and the drive shaft to restrict further shifting of the barrier while causing minimal deflection of the resilient biasing member.

27. A system of claim 25 wherein the abutment member comprises a collar fixedly mounted on the drive shaft to prevent relative rotation between the drive shaft and the drum when the abutment surface of the drum contacts the collar to restrict further shifting of the barrier.

28. A system of claim 27 wherein abutment surface comprises slot in the drum extending between abutment ends thereof and the collar has a stop element that moves within the slot between the abutment ends thereof, engagement of the stop element with either of the abutment ends of the slot preventing further relative rotation between the collar and the drum.

29. A system of claim 27 wherein the collar has a slot formed therein extending between abutment ends thereof and the abutment surface comprises a stop element of the drum positioned to travel within the slot and between the abutment ends thereof, engagement of the drum stop element with either of the abutment ends of the slot preventing further relative rotation between the collar and the drum.

30. A system of claim 23 wherein the barrier is a garage door having a generally horizontal open position and a generally vertical closed position, the flexible actuator is a pull cable that pulls the garage door from the open to the closed position thereof.

31. A system of claim 30 wherein the drive shaft is a jack shaft having the drum mounted for rotation therewith and allowing a predetermined amount of relative rotation therebetween with the pull cable having one end attached adjacent an upper end of the door and the other end attached to the drum so that rotation of the jack shaft causing the cable to be taken upon the drum pulls the door from the horizontal open position toward the vertical closed position, and the predetermined limited amount of door shifting from the closed position is a short vertical distance.

32. A system of claim 31 wherein the short vertical distance of the door is approximately two inches.

33. A system of claim 23 wherein the flexible actuator shifts the barrier from the open position to the closed position upon drive shaft rotation in a predetermined rotational direction, and the predetermined limited amount of shifting of the barrier from the closed position toward the open position allowed by the stop mechanism is a predetermined distance that is of sufficiently small size to substantially prevent unauthorized entry into a space closed off by the barrier in its closed position.

* * * * *

UNITED STATES PATENT AND TRADEMARK OFFICE

CERTIFICATE OF CORRECTION

PATENT NO. : 6,883,579 B2
DATED : April 26, 2005
INVENTOR(S) : Olmsted

It is certified that error appears in the above-identified patent and that said Letters Patent is hereby corrected as shown below:

Column 21,
Line 28, after “a” delete “drive”;
Line 55, after “the” delete “of”;

Column 22,
Line 6, after “torsion”, delete “power”;
Line 12, change “an” to -- and --.

Signed and Sealed this

Seventh Day of March, 2006

JON W. DUDAS
*Director of the United States Patent and Trademark Office*